US005420558A

United States Patent [19]

Ito et al.

[11] Patent Number: 5,420,558

[45] Date of Patent: May 30, 1995

[54] THIN FILM TRANSFORMER

[75] Inventors: Naoki Ito; Tsuneo Watanabe; Yoshiyuki Sugahara; Toshio Komori, all of Kawasaki, Japan

[73] Assignee: Fuji Electric Co., Ltd., Kawasaki, Japan

[21] Appl. No.: 67,058

[22] Filed: May 26, 1993

[30] Foreign Application Priority Data

| | | | |
|---|---|---|---|
| May 27, 1992 | [JP] | Japan | 4-135073 |
| Aug. 21, 1992 | [JP] | Japan | 4-223033 |
| Sep. 14, 1992 | [JP] | Japan | 4-244786 |

[51] Int. Cl.[6] ..... H01F 27/28

[52] U.S. Cl. ..... 336/200; 336/232

[58] Field of Search ..... 336/200, 232

[56] References Cited

U.S. PATENT DOCUMENTS

| | | | |
|---|---|---|---|
| 3,133,249 | 5/1964 | Parker . | |
| 4,246,446 | 1/1981 | Yoshida et al. | 369/136 |
| 4,313,152 | 1/1982 | Vranken | 361/402 |
| 4,613,843 | 9/1986 | Esper et al. | 336/232 |
| 4,794,338 | 12/1988 | Roemer et al. | 324/39 |
| 5,012,571 | 5/1991 | Fujita et al. | 29/598 |
| 5,239,288 | 8/1993 | Tsals | 336/120 |

FOREIGN PATENT DOCUMENTS

| | | | |
|---|---|---|---|
| 0006959 | 1/1980 | European Pat. Off. . | |
| 0035964 | 9/1981 | European Pat. Off. . | |
| 0413348 | 2/1991 | European Pat. Off. . | |
| 2917388 | 11/1980 | Germany . | |
| 3423139 | 1/1985 | Germany . | |
| 290838 | 6/1991 | Germany | 336/200 |
| 4117878 | 12/1991 | Germany . | |
| 4137043 | 4/1993 | Germany . | |
| 4233086 | 4/1993 | Germany . | |
| 2-275606 | 11/1990 | Japan . | |
| 2050699 | 1/1981 | United Kingdom . | |
| 2087656 | 5/1982 | United Kingdom . | |
| 2132030 | 6/1984 | United Kingdom . | |
| 2173956 | 10/1986 | United Kingdom . | |
| 2184606 | 6/1987 | United Kingdom . | |
| 2260222 | 4/1993 | United Kingdom . | |

*Primary Examiner*—Gerald P. Tolin
*Assistant Examiner*—L. Thomas
*Attorney, Agent, or Firm*—Spencer, Frank & Schneider

[57] ABSTRACT

A thin film transformer which is fabricated on a substrate includes first and second thin film coils. One of the coils includes either of at least two spiral shaped coil parts that are disposed below an insulation layer and either of at least two spiral shaped coil parts that are disposed above the insulation layer, the coil parts being connected through a connection hole in the insulation layer, with terminals for the coil being located outside the outer loops of the coil parts. The other of the coils includes other coil parts that are connected through a connection hole in the insulation layer, with terminals again being located outside the outer loops of the coil parts. With this configuration, the first and second thin film coils have terminals that are located outside of the outer loops of the coils. Side-by-side transformers whose primaries and secondaries are connected so as to form a single transformer are also disclosed.

32 Claims, 24 Drawing Sheets

THIN FILM TRANSFORMER

BACKGROUND OF THE INVENTION

1. Field of the Invention

The present invention relates to a thin film transformer having a spiral thin film coil and more particularly to a technology for forming a coil consisting of a conductive material.

2. Description of the Prior Art

Thin film transformers formed on semiconductor substrates consisting of silicon or the like are known. Such transformers can be small in size because they are fabricated by a thin film development technology. They are among the electronic devices for forming semiconductor integrated devices. A conductive wiring pattern made of a conductive material or semiconductor is used for forming coils in thin film transformers. The shape of the coils is selected to be spiral in order to obtain a large Q-value ($Q=\omega L/R$ where $\omega$ is angular frequency, L is mutual inductance and R is the resistance of the coil). An example of a thin film transformer with a spiral structure is shown in FIGS. 1A and 1B. FIG. 1A is a plan view showing the structure of a conventional thin film transformer, and FIG. 1B is a cross-sectional view taken along the line I—I in FIG. 1A. As shown in FIGS. 1A and 1B, a thin film transformer 130, which is formed on a substrate 131, includes a silicon dioxide layer **132*a*, a primary coil 133, a silicon dioxide layer 132*b*, a secondary coil 134, and a silicon dioxide layer 132*c* superimposed on the substrate 131 in this order. The hatched region in FIG. 1A indicates a region in which the primary coil 133 and the secondary coil 134 overlap when viewed from above or in projection. The thin film transformer 130 is formed as follows. First, the silicon dioxide layer 132*a* is deposited on the surface of the substrate 131 to a thickness of from 0.1 to 2 μm. A highly conductive metallic material such as aluminum is deposited on the upper surface of the silicon dioxide layer 132*a* to a thickness of from 1 to 3 μm by a sputtering method or a vacuum deposition method to form a metallic film. Next, the metallic film thus formed is processed by lithography and etching in order to transfer spiral patterns to produce a metallic line having a width of from 50 to 200 μm and having a wiring spacing or pitch of from 50 to 200 μm. The metallic line forms a coil 133 and has a spiral pattern, with a plurality of corners at which two adjacent metallic line segments merge with each other. After the further silicon dioxide layer 132*b* is formed to a thickness of from 0.1 to 2 μm on the primary coil layer 133, the secondary coil layer 134 is formed on the silicon dioxide layer 132*b* to a thickness of from 1 to 3 μm in a manner similar to the primary coil layer 133. Then, the silicon dioxide layer 132*c* is formed to a thickness of from 1 to 2 μm on the surface of the primary coil 134 layer. In order to make both ends 135*a* and 135*b* of the primary coil 133, and both ends 136*a* and 136*b* of the secondary coil 134, exposed for electrical connections, the silicon oxide layers 132*b* and 132*c* above the end terminals 135*a*, 135*b*, 136*a*, and 136*b* of the primary coil 133 and the secondary coil 134 are each partially removed by lithography and etching, and finally the thin film transformer 130 is completed. In the thin film transformer 130, the numbers of turns of the primary coil 133 and the secondary coil 134 are each 4, and the secondary coil 134 has the same pattern as the primary coil 133 and is positioned in the same area as that occupied by the primary coil 133**. In other words, their projected areas overlap completely except for the terminals.

In a thin film transformer formed as described above, a modification of the quantity of current running from the end **135*a* to the end 135*b* of the primary coil 133 results in a change in the magnetic field generated around the primary coil 133, and an electric potential difference appears between the ends 136*a* and 136*b* of the secondary coil 134 to generate electromotive force. The induced electromotive force (induced current) generated in the secondary coil 134 is proportional to the number of turns of the secondary coil 134. The larger the number of turns of the primary coil 133, the higher the intensity of magnetic field generated by the primary coil 133, which leads to generating a larger induced electromotive force in the secondary coil. Thus, in the thin film transformer 130 which produces electromotive force by means of mutual inductance between the coils 133, 134, the larger the numbers of turns of the primary coils and the secondary coils, the higher the intensity of the magnetic field generated by each of the coils so that the inductance between the coils increases, and also the coupling coefficient becomes larger, resulting in that the efficiency of energy conversion from the primary coil 133 to the secondary coil 134** can be increased.

However, a thin film transformer formed as described above suffers from various problems. For example, if the numbers of turns of the primary coil 133 and the secondary coil 134 is increased, the overall area of the thin film transformer 130 becomes larger, which hinders the fabrication of small-sized transformers. In addition, increasing the numbers of turns of the coils leads directly to an increase in the length of the coils. A thin film conductor has a resistance which is generally much higher than the resistance of a wire. Hence, a problem would arise in that the energy loss due to the increased resistance of thin film coils when their length is increased could cause a reduction of Q-values, which serves as an index of energy conversion efficiency.

Thus, in the conventional thin film transformer 130, an increase in the number of turns of the coils for increasing the energy conversion efficiency and a reduction in the size of the coils have a trading-off relationship, and there is a possibility that increasing the number of turns may cause reduction in the energy conversion efficiency.

SUMMARY OF THE INVENTION

Under the circumstances, an object of the present invention is to provide a thin film transformer apparatus which has an improved structure and can easily achieve increased energy conversion efficiency without increasing the area occupied by coils.

According to a first aspect of the present invention, there is provided a thin film transformer apparatus comprising:

a first thin film coil consisting of a conductive material developed on a surface of a substrate; and a second thin film coil consisting of a conductive material developed on an insulation layer formed on the first thin film coil, in which one of the first thin film coil and the second thin film coil is formed so that either of a plurality of at least two-lined lower-layer side coil parts formed at a lower-layer side of the insulation layer in a spiral shape with a designated wiring gap defined in a direction along a surface of the substrate and a plurality of at least two-lined upper-layer side coil parts formed at an upper-layer side of the insulation layer in a spiral shape with a designated wiring gap defined in a direction along a surface of the substrate may be connected electrically to each other through the insulation layer and so that the terminals of the coil are located outside of the outer loops of the coil parts, and in which the other of the first thin film coil and the second thin film coil is formed so that the other of a plurality of the lower-side coil parts and a plurality of the upper-layer coil parts may be connected electrically to each other through the insulation layer and so that the terminals of the coil are located outside of the outer loops of the coil parts;

thereby the first thin film coil and the second thin film coil have terminals located outside of the outer loops of the first thin film coil and the second thin film coil.

Here, the first thin film coil may comprise:

a first coil part as the lower-layer coil part having a terminal located outside an outer loop of the lower-layer coil part, and a second coil part as the upper-layer coil part having a terminal outside an outer loop and having a terminal inside a loop connected electrically to a terminal inside a loop of the first coil part thorough the insulation layer; and in which the second thin film coil comprises:

a third coil part as the lower-layer coil part having a terminal located outside an outer loop of the lower-layer coil part, and a fourth coil part as the upper-layer coil part having a terminal outside an outer loop and having a terminal inside a loop connected electrically to a terminal inside a loop of the first coil part through the insulation layer.

The first thin film coil and the second thin film coil may be shaped in an identical spiral pattern, and in which a development area of the coils is determined so that the first thin film coil and the second thin film coil may overlap if the development area is hypothetically rotated around a point inside an inner loop of a thin film transformer consisting of the first thin film coil and the second thin film coil.

The upper-layer and the lower-layer may each have three or more coil parts, and the number of turns of the first thin film coil and the number of turns of the second thin film coil may be made unequal to each other by using a different number of connections between the upper-layer coil parts and the lower-layer coil parts in the first thin film coil and the second thin film coil.

The thin film transformer apparatus may include terminals located below the insulation layer among a plurality of terminals included in the first thin film coil and the second thin film coil.

In the thin film transformer apparatus, a tapered connection hole in the insulation layer may be used for connecting electrically the upper-layer coil part and the lower-layer coil part, the tapered hole having a cross-section which increases from the lower-layer side to the upper-layer side.

In the thin film transformer apparatus, the spiral patterns of the upper-layer coil part and the lower-layer part may have identical wiring widths and wiring gaps.

At least one of the upper-layer coil part and the lower-layer coil part may have a plurality of conductive lines connected electrically in parallel and having an identical wiring width and an identical wiring gap.

The thin film transformer apparatus development area of the first thin film coil and the second thin film coil may be defined so that an overlap area between the first thin film coil and the second thin film coil may be maximized.

The thin film transformer apparatus may further comprise an integrated assembly of a plurality of thin film transformers adjacent to one another arranged on the substrate, each thin film transformer having a first thin film coil and a second thin film coil, and in which a gap between adjacent thin film transformers is less than or equal to the width of a conductor of the thin film coils.

According to a second aspect of the present invention, there is provided an integrated thin film transformer apparatus having a plurality of thin film transformers integrally arranged adjacent to one another on the substrate, each thin film transformer comprising:

a first thin film coil consisting of a conductive material formed in a spiral shape having a designated wiring gap developed on a surface of a substrate; and a second thin film coil consisting of a conductive material developed on an insulation layer formed on the first thin film coil, in which a distance between a pair of the adjacent thin film transformers is less than or equal to both a wiring width of the first thin film coil and a wiring width of the second thin film coil.

Here, the first thin film coil and the second thin film coil may have an identical spiral pattern and occupy an identical position on a surface of the substrate.

In the integrated thin film transformer apparatus, a plurality of first thin film coils may be connected electrically to each other in parallel, and a plurality of second thin film coils may also be connected electrically to each other in parallel.

The adjacent thin film transformers may be arranged in a line symmetry with respect to a central line passing through a central point of the thin film transformers on the substrate.

In the integrated thin film transformer apparatus, at least one pair of adjacent thin film transformers may share commonly a coil element included in an outermost loop of the first thin film coil; and at least one pair of adjacent thin film transformers may share commonly a coil element included in an outermost loop of the second thin film coil.

In the thin film transformer apparatus, a magnetic material layer may be formed separately from the first thin film coil and the second thin film coil within an insulation body on a surface of the substrate.

The magnetic material layer is disposed in at least one of a position between the substrate and the first thin film coil layer, a position between the first thin film coil layer and the second thin film coil layer, and a position above the upper thin film coil layer.

In the thin film transformer apparatus, a development area of the magnetic material layer may have an eddy current buffer part used as a separation area of the magnetic material layer.

The first thin film coil and the second thin film coil may be formed so as to have a spiral pattern including a plurality of corner parts and straight line parts between pairs of corner parts; and slits for providing eddy current buffers may be formed in the magnetic material layer between regions thereof corresponding to the corner parts.

Eddy current buffers may be also be formed parallel to the straight line parts of the first thin film coil and the second thin film coil.

The magnetic material layer may be formed so as to surround a peripheral area of a development area of the first thin film coil and the second thin film coil.

The magnetic material layer may be implemented in the insulation body in an area where the first thin film coil and the second thin film coil are not developed and a central part of the first thin film coil and the second thin film coil exists, the area being located at an inner loop of the first thin film coil and the second thin film coil.

The magnetic material layer may be formed as a lower magnetic material layer and an upper magnetic material layer on both a lower layer side and an upper layer side of the first thin film coil and the second thin film coil; and the lower magnetic material layer and the upper magnetic material layer may be connected to each other at an area where the first thin film coil and the second thin film coil are not developed and a central part of the first thin film coil and the second thin film coil exists.

The substrate may consist of a material selected from the group consisting of semiconductor, glass, film and metal.

In the integrated thin film transformer apparatus a magnetic material layer may be formed separately from the first thin film coil and the second thin film coil with an insulation layer on a surface of the substrate.

In a thin film transformer having individual thin film transformers having the most basic structure to which the third measure is applied, a plurality of thin film transformers, each adjacent to each other, are developed on the same substrate, and these thin film transformers are integrated and arranged with the distance between adjacent thin film transformers being less than or equal to the coil gap between adjacent coil lines. Therefore, in the integrated thin film transformer, a coil portion of another coil which generates a magnetic field exists in the vicinity of the outermost loop or turn of a given individual thin film transformer, which enhances the magnetic coupling at the coil portion of the given thin film at its outermost turn with the adjacent thin film transformer. This enhances the magnetic field generated by each thin film transformer. Thus, in the integrated thin film transformer of the present invention, there can be attained not only the integration of a plurality of thin film transformers but also an increase in the intensity of generated magnetic field. In the case where the first thin film coil used as the primary circuit and the second thin film coil used as the secondary circuit have an identical spiral pattern and occupy an identical position or overlap in projection, the magnetic coupling effect can be more enhanced. The individual thin film transformers may be arranged with reduced widths and coil pitches without expanding the development area occupied by the coils, and also a reduction in the length of a thin film coil can give rise to reduced resistance, which leads to reduction in energy conversion loss.

The first thin film coils of a plurality of thin film transformers may be electrically connected to each other in parallel and likewise the second thin film coils thereof may be electrically connected to each other in parallel, thus forming an integrated transfer consisting of a plurality of individual or unitary thin film transformers electrically connected in parallel. In this case, the resistances of the respective transformers are connected in parallel, which makes it possible to prevent an increase in the overall resistance of the integrated thin film transformer and to decrease loss in the energy transfer efficiency.

If a pair of thin film transformers adjacent to each other are placed in a line-symmetrical geometry with respect to a line parallel to the surface of the substrate, i.e., a center line defined between these two thin film transformers, electric currents in the opposing coil portions, arranged in line-symmetrical arrangement with respect to the aforementioned center line, of two thin film transformers adjacent to each other flow in the same direction, assuming that direct currents were applied. This means that the number of turns of the coils increases effectively in each thin film transformer, resulting in that the coupling of magnetic fields is increased and the intensity of the magnetic field can be enhanced. Furthermore, if the outermost turn or loop of the first thin film coil and that of the second thin film coil are each shared by a couple of adjacent thin film coils, the phases of the currents running in the shared coils are completely synchronized between the two adjacent thin film transformers, with the result that the quantity of current running in the outermost turn or loop of the coil, where generically the coupling of the magnetic field is the weakest among all the coil parts in the coil concerned, can be increased up to twice as much as the quantity of current running in other parts of the coils. Therefore, the coupling of the magnetic field can be increased, and finally, the transformer performance measured in terms of energy conversion efficiency can be increased.

In contrast, in the thin film transformer to which the first measure and the second measure are applied, lower-layer coil parts and upper-layer coil parts are formed on the substrate, and at least one coil part in the upper-layer and at least one coil part in the lower-layer are connected electrically in series to one another through at least one connection hole in the insulation layer in order to form a first thin film coil, and a second thin film coil is formed by electrically connecting, in series, the other lower-layer coil parts and the other upper-layer coil parts. In this configuration, terminals connected to the thin film transformer can be placed on the outer side of, or outside the peripheral edge of, the integrated thin film transformer.

For example, if a first coil part and a third coil part are formed on the substrate, and a second coil part and a fourth coil part are formed on an insulation layer which covers the first and third coil parts, the first coil part and the second coil part can be connected to each other at their innermost coil turns or loops to provide a first thin film coil having terminals on the side of the outermost turns or loops. Similarly, the third coil part and the fourth coil part can be connected to provide a second thin film coil having terminals on the outermost turns or loops. Thus, there is no need for wiring since the innermost ends of the coil parts have no terminals. In the thin film transformer, the intensity of the magnetic flux has its maximum intensity at the center of the thin film coils. However, as there are no terminals inside the innermost turns or loops of the coils in the thin film transformer of the present invention, it is unnecessary to provide metallic wiring which is connected to the innermost turns of the coils. Therefore, the external magnetic field generated by the thin film transformer itself is not disturbed by the current running in metallic wiring connected to terminals at the innermost turns of the coils. In addition, if a plurality of thin film transformers are placed on both sides of the substrate for forming an integrated thin film transformer apparatus as in the thin film transformer apparatus to which the third measure is applied, the wiring method for connecting coils to external terminals is not limited to a wire bonding method since terminals for the transformer apparatus are provided only at the peripheral edges of the transformer development area. Wiring can be connected to the individual thin film transformers by using a conductive material layer developed at the same time when the coil components of the thin film coils are formed in the manufacturing process.

Thin film transformers having turn number ratios other than 1:1 (which means that the number of turns of the first thin film coil is not equal to the number of turns of the second thin film coil) can be obtained by forming three or more upper-layer coil parts and three or more lower-layer coil parts, with the upper-layer coil parts and the lower-layer coil parts being connected in series to form first and second thin film coils such that the number of connections between upper-layer coil parts and lower-layer coil parts is different for the first and second thin film coils. If an integrated thin film transformer apparatus comprising a plurality of individual thin film transformers is to be made, the terminals to external devices are formed at the peripheral edges of the development area of the individual thin film transformers, which enables wiring to be formed by using a conductive material layer developed at the same time when the coil components of the thin film coils are formed in the manufacturing process.

With respect to the thin film transformer apparatus of the present invention, if a magnetic material layer is provided in the insulation body and separated from the first and second thin film coils, leakage of the magnetic flux can be reduced since the magnetic material layer can capture the leaked magnetic flux as well as enhance the intensity of the magnetic flux generated by the coils themselves, and therefore, the intensity of the magnetic field can be raised further.

BRIEF DESCRIPTION OF THE DRAWINGS

FIG. 2A is a cross-sectional view taken along the line II—II in FIG. 2A;

DESCRIPTION OF PREFERRED EMBODIMENTS

Now, referring to accompanying drawings, embodiments of the integrated thin film transformer of the present invention will be described in more detail.

Embodiment 1

Figure 2A:
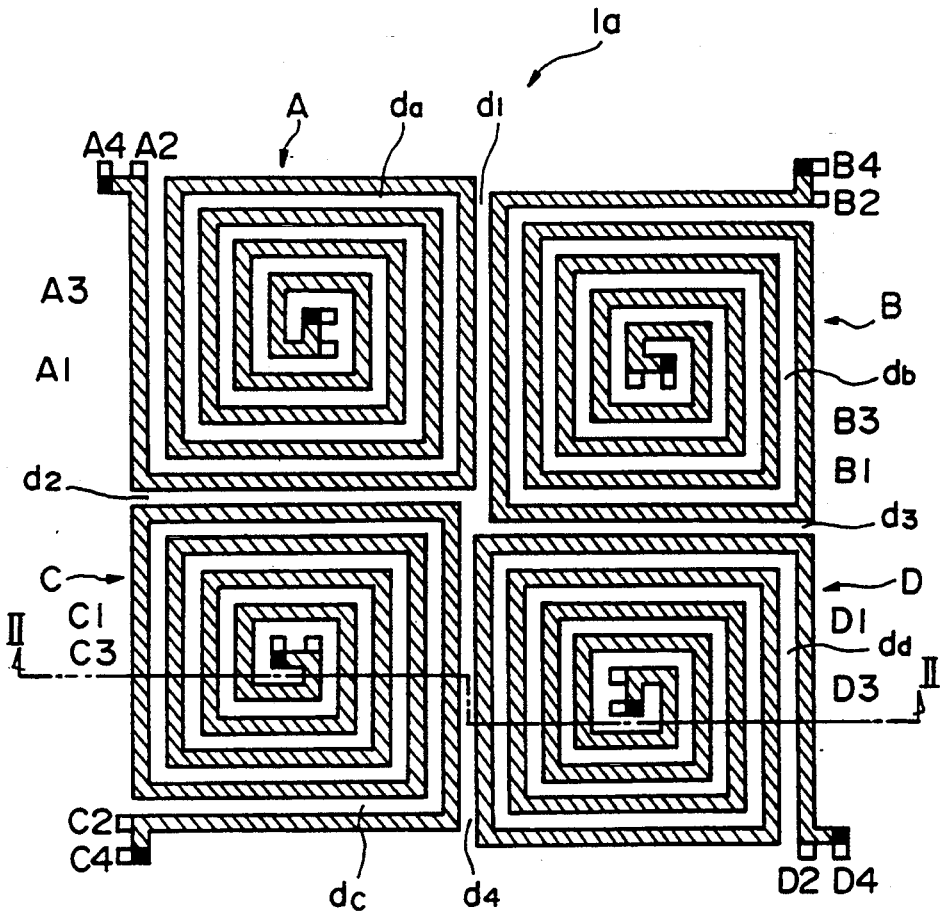
FIG. 2A is a plan view showing the structure of the integrated thin film transformer in embodiment 1 of the present invention.
Figure 2B:
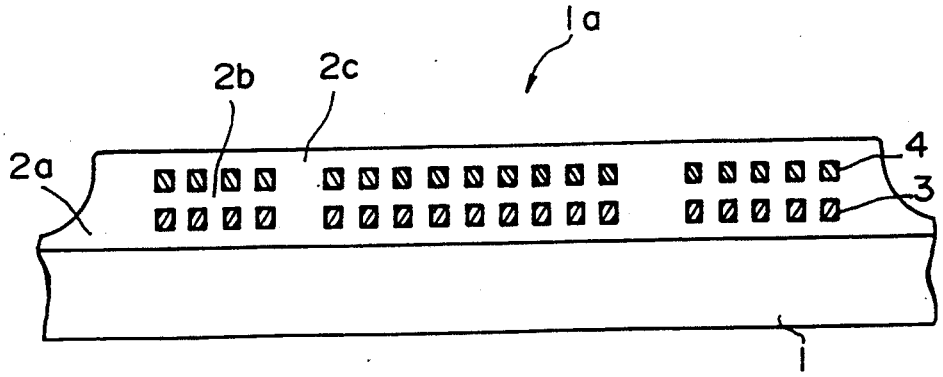

FIG. 2A is a plan view showing the structure of an integrated thin film transformer (a thin film transformer apparatus using the third measure of the present invention) in accordance with a first embodiment of the present invention, and FIG. 2B is a cross-sectional view of the thin film transformer taken along the line II—II. In these figures, an integrated thin film transformer 1*a* has a primary coil and a secondary coil and a layout structure in which four thin film transformers A, B, C and D with identical dimensions are formed on the same substrate so as to be adjacent to each other. The distances d1, d2, d3 and d4 between individual pairs of thin film transformers A, B, C and D that are adjacent to each other are the same as the widths $d_a$, $d_b$, $d_c$ and $d_d$ of the gaps between adjacent turns of the spiral coils of the thin film transformers A, B, C and D. In addition, in the thin film transformers A, B, C and D, terminals A1 to A4, B1 to B4, C1 to C4, and D1 to D4 are mounted at the end terminals of the primary coils and the secondary coils for connecting parts electrically.

Figure 1A:
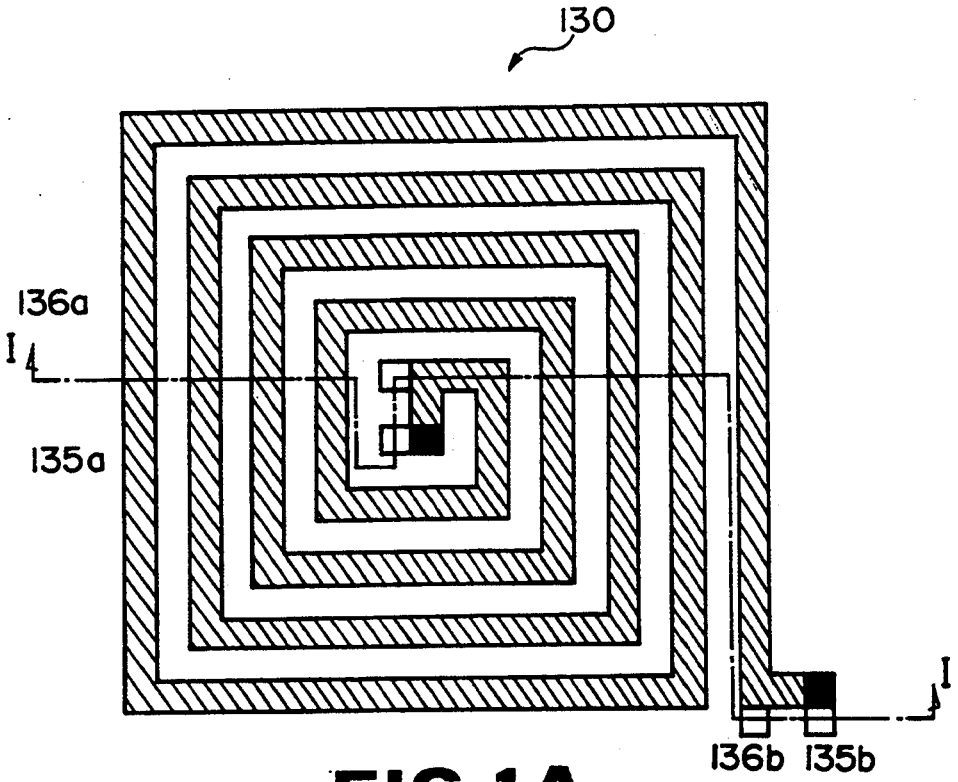
FIG.1A (PRIOR ART)
FIG. 1A is a plan view showing the structure of a thin film transformer of the prior art.
Figure 1B:
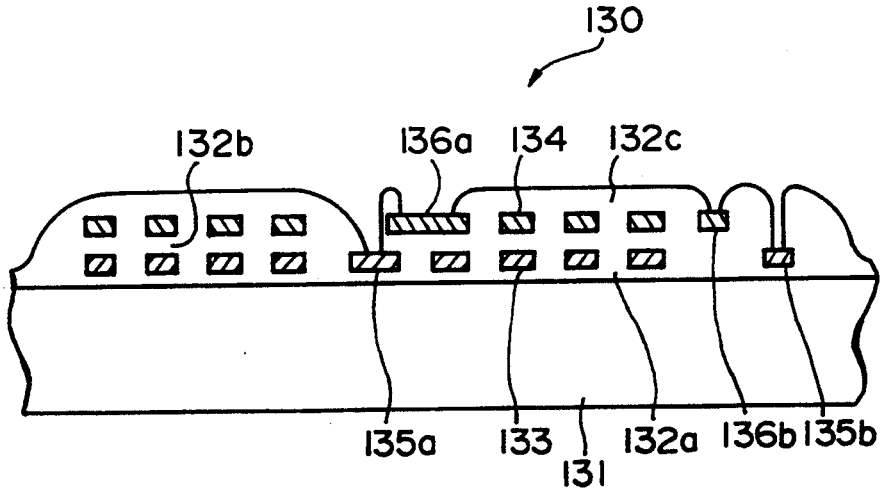
FIG.1B (PRIOR ART)
FIG. 1B is a cross-sectional view taken along the line I—I in FIG. 1A.

To fabricate the integrated thin film transformer 1*a* shown in FIG. 2A, four thin film transformers A, B, C and D, are formed on the surface of a silicon substrate 1 (see FIG. 2B) at the same time in a thin film development process. In the thin film development process, a 0.1 to 2 μm silicon dioxide layer 2*a* is formed on the surface of the silicon substrate, and furthermore, a 1 to 3 μm (e.g., 1 μm) thin film of metallic material having high electric conductivity, such as copper or iron, is deposited on the silicon dioxide layer 2*a* by sputtering or vacuum deposition so as to form a uniform conductive layer. And next, patterns for four spiral coils having a 20 μm line-width and a 20 μm gap-width are formed on the metallic layer by lithographic processing or etching processing, and thus, a primary coil 3 (the first thin film coil) is formed. And after coating the surface of primary coil 3 with a 0.1 to 2 μm silicon dioxide layer 2*b*, a secondary coil 4 (the second thin film coil) having a thickness of 1 to 3 μm (e.g., 1 μm) is formed on the silicon dioxide layer. Finally, a silicon dioxide layer 2*c* having a thickness of 1 to 2 μm is formed on the surface of the secondary coil 4 so that the integrated thin film transformer 1*a* may be established. The number of turns of the primary coil 3 and the number of turns of the secondary coil 4 is 4. Coils 3 and 4 have identical spiral patterns and identical relative positions in projection on the surface of the silicon substrate 1. The line width and the length of the primary and secondary coils 3 and 4 are about half of those of the coils in the prior art thin film transformer 130 shown in FIGS. 1A and 1B, and the area occupied by a single thin film transformer, that is, A, B, C or D, is reduced by ¼. Consequently, in the same area occupied by the prior art thin film transformer 130, four thin film transformers having spiral coils with the same number of turns can be accommodated according to the present invention. In this embodiment, in the integrated thin film transformer 1*a*, the thickness of a coil line is taken to be 1 μm, equivalent to that of a coil line in the prior art, in order to make the resistance of the coil line equivalent to that in the prior art. With respect to the materials used for forming thin films to make the primary and secondary coils 3 and 4, it may be possible to use semiconductor materials such as polysilicon as well as metallic materials having high electric conductivity.

Figure 3:
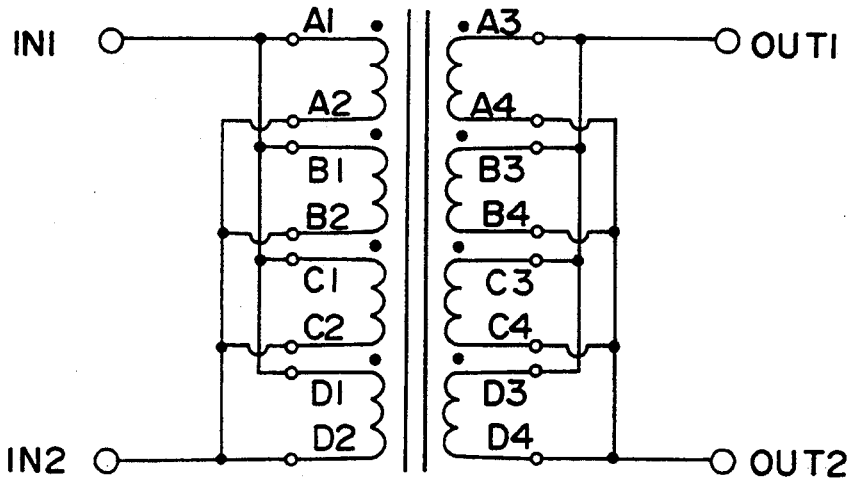
FIG. 3 is a circuit diagram showing a circuit equivalent electrically to the integrated thin film transformer shown in FIGS. 2A and 2B.

FIG. 3 shows the equivalent circuit of the integrated thin film transformer 1*a* of this embodiment. In the integrated thin film transformer 1*a* of this embodiment, four primary coils 3 are electrically connected in parallel—the primary coil of the thin film transformer A, the primary coil of the thin film transformer B, the primary coil of the thin film transformer C and the primary coil of the thin film transformer D. As for the secondary coils 4, the secondary coils of the thin film transformers A, B, C and D are also connected electrically in parallel. For example, as shown in FIG. 3, the input terminal IN1 is defined by connecting commonly the terminals A1, B1, C1 and D1 of the primary coils of the thin film transformers A, B, C and D, and the input terminal IN2 is defined by connecting commonly terminals A2, B2, C2 and D2 of the primary coils, and thus, the input terminals IN1 and IN2 are defined as the primary circuit of the integrated thin film transformer 1*a*. The output terminal OUT1 is defined by connecting commonly the terminals A3, B3, C3 and D3 of the primary coils of the thin film transformers A, B, C and D, and the output terminal OUT2 is defined by connecting commonly terminals A4, B4, C4 and D4 of the primary coils, and thus, the output terminals OUT1 and OUT2 are defined as the secondary circuit of the integrated thin film transformer 1*a*.

In an integrated thin film transformer 1*a* formed in the above manner, the intensity of the electric field that can be generated around the individual thin film transformers A, B, C and D is relatively high and the performance of the transformer can be increased. More specifically, in the integrated thin film transformer 1*a*, each of the individual thin film transformers A, B, C and D is adjacent a thin film transformer at a distance (intertransformer gap) selected to be the same as $d_a$, $d_b$, $d_c$ and $d_d$, respectively, at the outside of the outermost turn of the thin film coil. This configuration guarantees that the intensity of the magnetic field developed at the outermost turn of the coil will be relatively high, while the magnetic field generated by a single coil is generally not so strong without magnetic field interaction. Therefore, the performance of the integrated thin film transformer 1*a* can be increased and integration of the transformer components can still be attained; the mutual inductance of the integrated thin film transformer 1*a* is about 2 to 3 times (e.g., 2.5 times) as large as the conventional thin film transformer 130 when using an identical current in the individual thin film transformers A, B, C and D and in the conventional thin film transformer 130. As the individual thin film transformers A, B, C and D are electrically connected in parallel in the integrated thin film transformer 1*a*, the overall resistance of the integrated thin film transformer 1*a* is about ¼ of the resistance of the conventional thin film transformer 130. The energy conversion efficiency when transferring energy from the primary coil to the secondary coil is as presented below in terms of Q-values when the Q-value of the transformer is compared with the Q-value of the conventional thin film transformer 130:

Since $Q=\omega L/R$, the Q-value, $Q_{130}$, of the conventional thin film transformer 130 is given by $Q_{130}=\omega L_{130}-/R_{130}-$(equation 1), and the Q-value, $Q_1$, of the integrated thin film transformer 1*a* is given by $Q_1=\omega L_1/R_1-$(equation 2).

Using the conversion, $L_1=2.5L_{130}$ and $R_1=0.25R_{130}$, equation (2) can be rewritten to provide the following equation (2'), $$Q_1=\omega\cdot 2.5L_{130}/0.25R_{130}=10\omega L_{130}/R_{130}-(\textit{equation } 2').$$

Thus, the energy conversion efficiency in terms of Q-value of the integrated thin film transformer 1*a* in this embodiment is 10 times as large as the conventional thin film transformer 130.

Since, in the integrated thin film transformer 1*a* in this embodiment, thin film transformers A, B, C and D are arranged in a two-dimensional configuration on an identical substrate, and the distances between adjacent thin film transformers, $d_1$, $d_2$, $d_3$ and $d_4$, are the same as the gaps or spacings (pitch) of the coil pattern of their primary and secondary coils, $d_a$, $d_b$, $d_c$ and $d_d$, the outermost turns of the individual thin film transformers A, B, C and D interact electromagnetically with each other. Hence, the electric field developed at the outermost turn of the coils is relatively large and the mutual inductance of the integrated thin film transformer 1*a* can be relatively high, which leads to an improvement of the energy conversion efficiency in transferring electric energy from the primary coil to the secondary coil. In addition, since the sizes of the individual thin film transformers A, B, C and D are reduced by making the coil width and the gap of the coil pattern of the primary and secondary coils 3 and 4 small, the occupied area of the overall integrated thin film transformer 1*a* does not increase.

In this embodiment, the individual thin film transformers A, B, C and D of the integrated thin film transformer 1*a* are connected electrically in parallel. The circuit configuration is not limited to this one, and a combination of parallel and series connections of the coils can be used. In either case, the structure of the integrated thin film transformer 1*a* can be optimized by selecting suitable values for the number of thin film transformer components, the number of turns of each thin film transformer, and the resistance of the coil circuit of the thin film transformer. For example, the mutual inductance of the integrated thin film transformer 1*a* in this embodiment, in which all the individual thin film transformers A, B, C and D are connected electrically in parallel, can be 2.5 times as large as the conventional thin film transformer 130, and the mutual inductance of an integrated thin film transformer in which all the individual thin film transformers A, B, C and D are connected electrically in series is 0.6 times as large as the conventional thin film transformer 130. And furthermore, if series and parallel connections of individual thin film transformers are combined to provide two parallel sets of transformer pairs that are connected in series, the mutual inductance is 2.5 times as large as the conventional thin film transformer 130.

The individual thin film transformers can be placed so that the distances between adjacent individual thin film transformers, $d_1$, $d_2$, $d_3$ and $d_4$, are smaller than the gaps of the coil pattern of the primary and secondary coils, $d_a$, $d_b$, $d_c$ and $d_d$. Furthermore the distances between adjacent individual thin film transformers, $d_1$, $d_2$, $d_3$ and $d_4$, may have random values less than the gaps of the coil pattern of the primary and secondary coils, $d_a$, $d_b$, $d_c$ and $d_d$.

Modification of Embodiment 1

As a modification of the integrated thin film transformer 1*a* of the embodiment 1, energy conversion efficiency can be increased and the size of the integrated thin film transformer 1*a* can be reduced by reducing the number of turns of the individual thin film transformers, A, B, C and D, to decrease the resistance of the coils. For example, if thin film transformers A, B, C and D having coils with three turns are used in a modified integrated thin film transformer 1*a*, the mutual inductance of the modified integrated thin film transformer can be increased to 1.3 times as large as the conventional thin film transformer, and the resistance of the modified integrated thin film transformer can be further reduced by about 30% relative to that of the original integrated thin film transformer 1*a*. Therefore, the energy conversion efficiency when transferring energy from the primary coil to the secondary coil is as presented below in terms of Q-values when the Q-value of the modified transformer is compared with the Q-value of the conventional thin film transformer 130;

The Q-value $Q_{1'}$, of a modified conventional thin film transformer is given by $$Q_{1'}=\omega L_{1'}/R_{1'}-(\textit{equation } 3).$$

Using the conversion, $L_{1'}=1.3L_{130}$ and $R_{1'}=0.18R_{130}$, equation (3) can be rewritten to provide the following equation (3'), $$Q_{1'}=\omega 1.3L_{130}/0.18R_{130}=7.2\ \omega L_{130}/R_{130}-(\textit{equation } 3').$$

Thus, the energy conversion efficiency in terms of Q-value of the modified integrated thin film transformer in this modification of the embodiment 1 is 7.2 times as large as the conventional thin film transformer 130. And furthermore, the area occupied by the modified integrated thin film transformer can be reduced to 60% of that of the conventional thin film transformer, which leads to an increase of the energy conversion efficiency per unit area.

Embodiment 2

Figure 4:
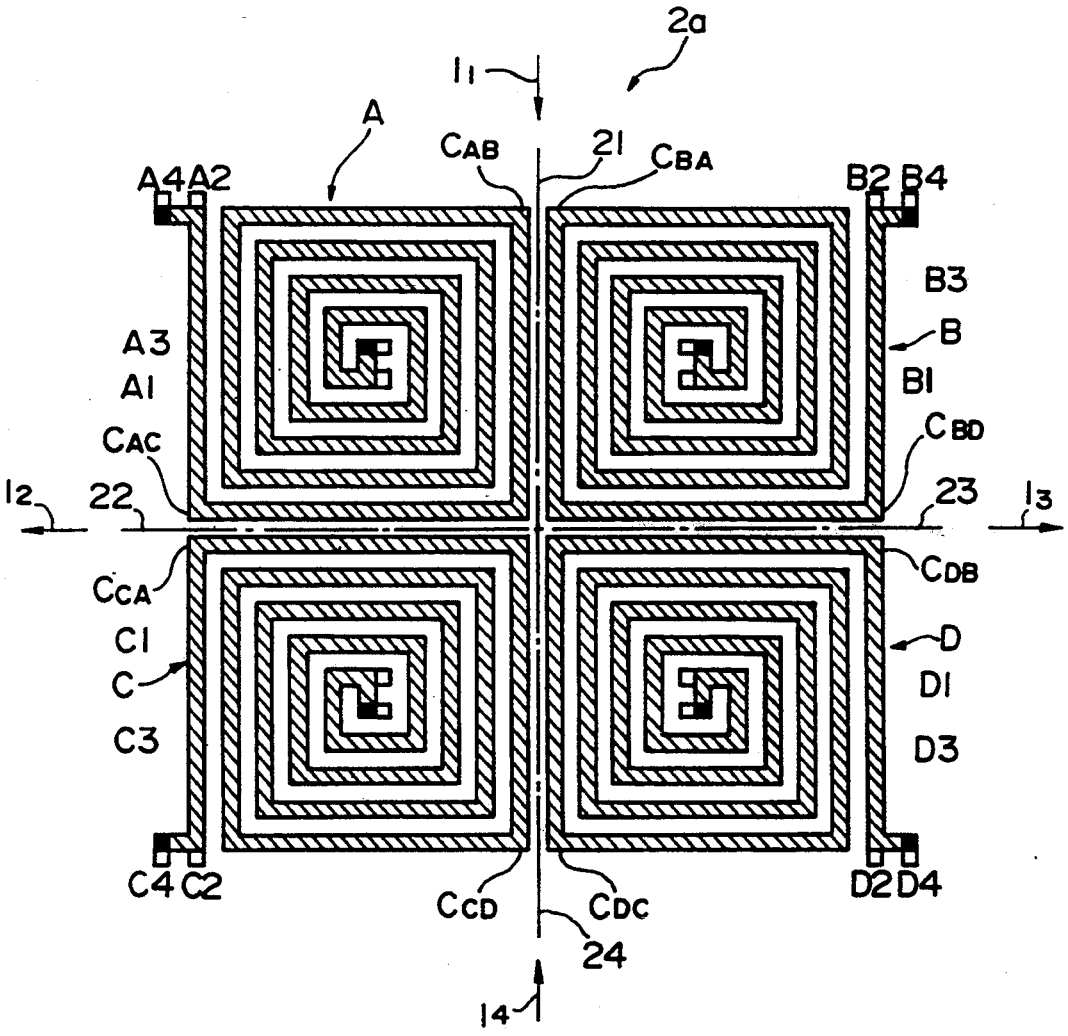
FIG. 4 is a plan view showing the structure of an integrated thin film transformer in embodiment 2 of the present invention.

FIG. 4 shows the structure of an integrated thin film transformer in embodiment 2 of the present invention. The structure of the integrated thin film transformer in this embodiment is similar to the structure of the integrated thin film transformer 1a in the embodiment 1, in both of which like parts are assigned like numerals, and their details and redundant descriptions are not repeated here.

In FIG. 4, the integrated thin film transformer 2a of this embodiment includes individual thin film transformers A, B, C and D that are placed in a linear symmetrical geometry with respect to a pair of straight lines crossing each other orthogonally and passing through the central point between the adjacent thin film transformers, which are formed on the surface of the silicon substrate 1. The thin film transformers A and B are placed in a linear symmetrical geometry with respect to a straight line segment 21 passing through the central point between these transformers. Similarly, the thin film transformers A and C are placed in a linear symmetrical geometry with respect to a straight line segment 22, the thin film transformers B and D are placed in a linear symmetrical geometry with respect to a straight line segment 23, and the thin film transformers C and D are placed in a linear symmetrical geometry with respect to a straight line segment 24.

In the integrated thin film transformer 2a formed in the above manner, when an electric current is led to the individual thin film transformers A, B, C and D, the currents running on the outermost segments of those coils flow in the same direction. If the individual thin film transformers A, B, C and D are connected in parallel in the same way as embodiment 1, and if, for example, a positive voltage is applied at the input terminal IN1 connected to the terminals A1, B1, C1 and D1 of the primary coils, an electric current runs in the direction $I_1$ within the outermost segment $C_{AB}$ of the thin film transformer A facing the thin film transformer B, and an electric current runs in the direction $I_1$ within the outermost segment $C_{BA}$ of the thin film transformer B facing the thin film transformer A. An electric current runs in the direction $I_2$ within the outermost segment $C_{AC}$ of the thin film transformer A facing the thin film transformer C, and an electric current runs in the direction $I_2$ within the outermost segment $C_{CA}$ of the thin film transformer B facing the thin film transformer A. Electric currents run in the direction $I_3$ within the outermost segments $C_{BD}$ and $C_{DB}$ of the thin film transformers A and B facing each other, and electric currents run in the direction $I_4$ within the outermost segments $C_{CD}$ and $C_{DC}$ of the thin film transformers C and D facing each other. Therefore, since the electric currents running on the outermost segments of the coils of the individual thin film transformers A, B, C and D of the integrated thin film transformer 2a in this embodiment are directed in uniform directions, coil segments in which the electric current runs in a synchronous phase exists outside the outermost segments of each coil, which means that the effective number of coil turns increases and which leads to an increase in the performance of the transformer in terms of the energy transfer efficiency by means of extending the magnetic field coupling at the outermost segments of the coils, where the intensity of the generic magnetic field is relatively small.

Even by placing the individual thin film transformers A, B, C and D so that the electric current running on the outermost segments of the coils of the individual thin film transformers A, B, C and D is directed in uniform directions, the currents may be shifted due to a phase change generated by the layout of the individual thin film transformers A, B, C and D and due to the connection capacitances at their connection terminals. In order to reduce the disturbance effect of the phase shift over the currents running in the coils and restrict the range of the phase shift to be between zero and $\pi$ radians, the floating capacitance and the relative capacitance of the insulation layer to the substrate should be controlled by adjusting the pitch of the coils and the thickness of the insulation layer on the substrate. In the case where individual thin film transformers having an identical size are arranged at an identical pitch and connected in parallel as in the integrated thin film transformer 2a in this embodiment, the phase shift is observed to be at most $\pi/2$ radians, which can be interpreted as meaning that a cyclic phase shift is not found in the current running at the outermost segments of the coils.

Embodiment 3

Figure 5:
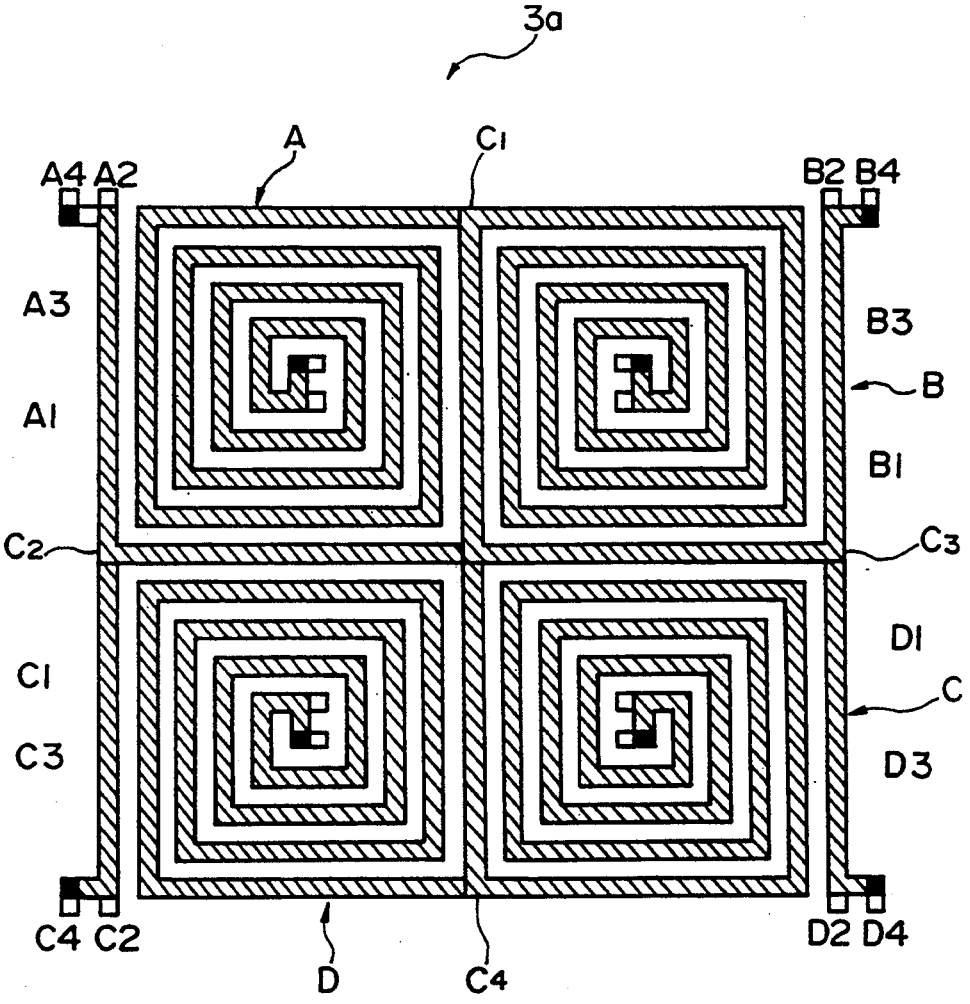
FIG. 5 is a plan view showing the structure of an integrated thin film transformer in embodiment 3 of the present invention.

FIG. 5 shows the structure of an integrated thin film transformer in embodiment 3 of the present invention. The structure of the integrated thin film transformer in this embodiment is similar to the structure of the integrated thin film transformer 2a in embodiment 2, in both of which like parts are assigned like numerals, and their details and redundant descriptions are not repeated here.

In FIG. 5, what is different in the integrated thin film transformer 3a from the thin film transformer 2a in the embodiment 2 is that the outermost coil parts of the spiral coils forming the individual thin film transformers A, B, C and D contain common segments shared by adjacent thin film transformers. That is, in the integrated thin film transformer 3a, the coil pattern is formed so that an outermost coil segment of the thin film transformer A overlaps an outermost coil segment of the thin film transformer B, forming a coil segment $C_1$ that is common to the thin film transformer A and the thin film transformer B. In similar manner, the thin film transformers A and C share a common coil segment $C_2$, the thin film transformers B and D share a common coil segment $C_3$, and the thin film transformers C and D share a common coil segment $C_4$.

In the integrated thin film transformer 3a, the phases of the currents running in the common coil segments $C_1$, $C_2$, $C_3$ and $C_4$ at the outermost coil parts of the individual thin film transformers A, B, C and D are completely synchronized, and the quantity of the current running in the common coil segments $C_1$, $C_2$, $C_3$ and $C_4$ is twice as large as the quantity of the current running in the inner coil segments of the individual thin film transformers A, B, C and D. Therefore, the intensity of the magnetic field developed by these thin film transformers can be relatively high and hence, the mutual inductance can be further increased. For example, the integrated thin film transformer 3a of this embodiment can attain a mutual inductance that is 1.3 to 2 times as large as that of the integrated thin film transformer 2a in embodiment 2. In addition, in the integrated thin film transformer 3a in this embodiment, since the individual thin film transformers A, B, C and D are arranged so that adjacent thin film transformers may share their outermost coil segments $C_1$, $C_2$, $C_3$ and $C_4$, the coil pattern can be simplified and its occupied area can be reduced.

An effect similar to that brought about by this embodiment can be obtained by forming at least one common coil segment shared by adjacent thin film transformers in an integrated thin film transformer and by using the layout of the individual thin film transformers A, B, C and D in the integrated thin film transformer 3*a* of this embodiment as an example.

Embodiment 4

Figure 6A:
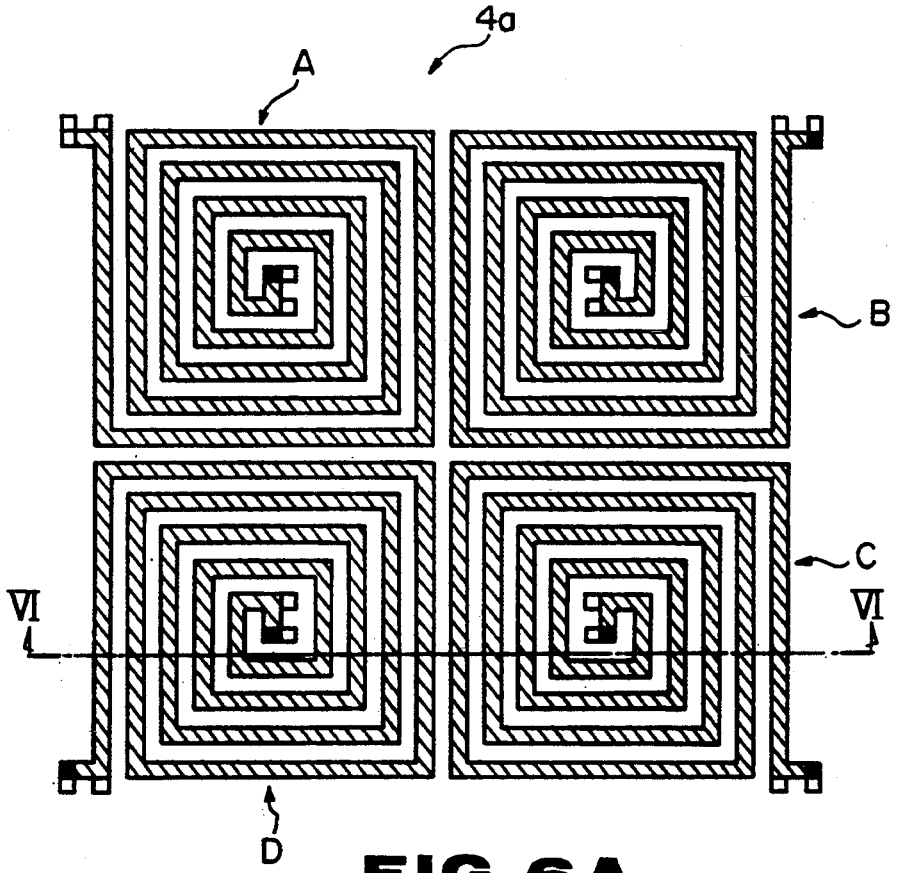
FIG. 6A is a plan view showing the structure of an integrated thin film transformer in embodiment 4 of the present invention.
Figure 6B:
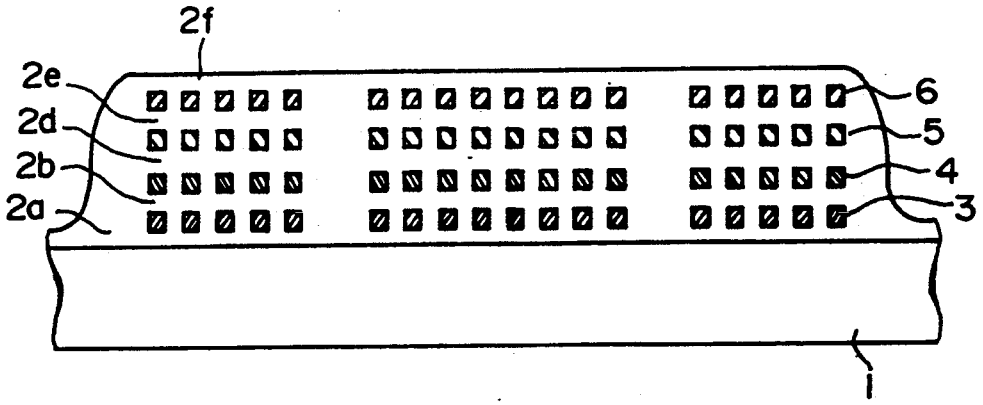
FIG. 6B is a cross-sectional view taken along the line VI—VI in FIG. 6A.

FIGS. 6A and 6B show the structure of an integrated thin film transformer in embodiment 4 of the present invention. FIG. 6A is a plan view of the structure of an integrated thin film transformer in this embodiment, and FIG. 6B is a cross-sectional view taken along line VI—VI. The structure of the integrated thin film transformer in this embodiment is similar to the structure of the integrated thin film transformer 2*a* in embodiment 2, in both of which like parts are assigned like numerals, and their details and redundant descriptions are not repeated here.

In FIGS. 6A and 6B, what is different in the integrated thin film transformer 4*a* from the thin film transformer 2*a* in embodiment 2 is that 4-layer thin film coils between which silicon dioxide layers are inserted are built up on the surface of the silicon substrate.

In the integrated thin film transformer 4*a*, after a 0.1 to 2 μm silicon dioxide layer 2*a* is formed on substrate 1 and primary and secondary coils 3 and 4 have been fabricated, a silicon dioxide layer 2*d* having a thickness of 0.1 to 2 μm is formed on the surface of the secondary coil 4. Then a tertiary coil 5 whose thickness is between 1 and 3 μm (e.g., 1 μm) is formed in a similar way to how the primary and secondary coils 3 and 4 were formed. And next, after forming a 0.1 to 2 μm silicon dioxide layer 2*e* on the surface of the tertiary coil 3, a fourth coil 6 having a thickness of 1 to 3 μm (e.g., 1 μm) is formed on the silicon dioxide layer 2*e*, and finally, a silicon dioxide layer 2*f* having a thickness of 1 to 2 μm is formed on the surface of the fourth coil 6 in order to complete the integrated thin film transformer 4 in this embodiment. In this embodiment, the number of turns of the primary, secondary, tertiary and fourth coils 3 to 6 is 4, each of which is formed with an identical spiral coil pattern at an identical position on the surface of the silicon substrate.

As for connecting the integrated thin film transformer 4*a* formed in the above manner, for example, as in embodiment 1 or 3, individual coils of the primary, secondary, tertiary and fourth coils 3 to 6 are connected in parallel, and furthermore, the primary coil 3 and the fourth coil 6 are connected in parallel in order to establish the primary circuit. On the other hand, the secondary coil 4 and the tertiary coil 5 are connected in parallel in order to establish the secondary circuit. In the integrated thin film transformer 4*a*, it will be appreciated that the intensity of the magnetic field generated by the overall integrated thin film transformer 4*a* is increased without increasing the occupied area size of the overall integrated thin film transformer 4*a*, due to the integration of the individual thin film transformers A, B, C and D similarly as in the embodiment 1 or 3, and due to the use of multiple-layered spiral coils.

In the integrated thin film transformer 4*a*, another connection pattern may be used for connecting individual thin film transformers, different from the connection method in this embodiment by combining parallel and series connection patterns with respect to the individual thin film transformers A, B, C and D and the primary, secondary, tertiary and fourth coils 3 to 6.

Embodiment 5

Figure 7:
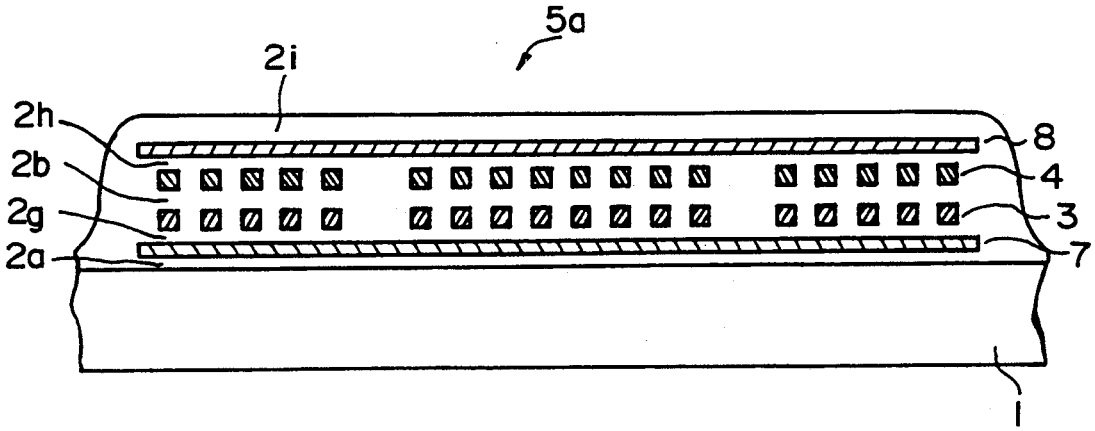
FIG. 7 is a cross-sectional view showing the major parts of the integrated thin film transformer in embodiment 5 of the present invention.

FIG. 7 shows the structure of an integrated thin film transformer in embodiment 5 of the present invention. The structure of the integrated thin film transformer in this embodiment is similar to the structure of the integrated thin film transformer 2*a* in embodiment 2, in both of which like parts are assigned like numerals, and their details and redundant descriptions are not repeated here.

In FIG. 7, what is different in the integrated thin film transformer 5*a* from the thin film transformer 2*a* in embodiment 2 is that magnetic material layers 7 and 8 are formed between the silicon substrate 1 and the primary coil 3, and above the surface of the secondary coil 4. In the integrated thin film transformer 5*a*, after forming a silicon dioxide layer 2*a* having a thickness of 0.1 to 2 μm on the surface of the silicon substrate 1, the magnetic material layer 7 (having a thickness of 0.1 to 1 μm) and a silicon dioxide layer 2*g* (having a thickness of 0.1 to 2 μm) are formed on the surface of the silicon dioxide layer 2*a*. And next, the primary coil 3 is formed on the surface of the silicon dioxide layer 2*g* by precise processing by a sputtering method and a lithographic method. In a repetitive manner, the silicon dioxide layer 2*b*, the secondary coil 4, a silicon dioxide layer 2*h*, the magnetic material layer 8 and a silicon dioxide layer 2*i* are formed sequentially on the primary coil 3, and finally the integrated thin film transformer 5*a* of this embodiment is completed.

In the integrated thin film transformer 5*a* structured in the above manner, the magnetic flux leakage is reduced since the magnetic flux is captured by the magnetic material layers 7 and 8, which increases the improvement in the intensity of the magnetic field due to the integration of the individual thin film transformers as described above with reference to embodiment 2. As for the magnetic material layer, magnetic materials such as Co, Ni, Fe and Cu can be used. The magnetic material can be deposited by sputtering.

Embodiment 6

Figure 8:
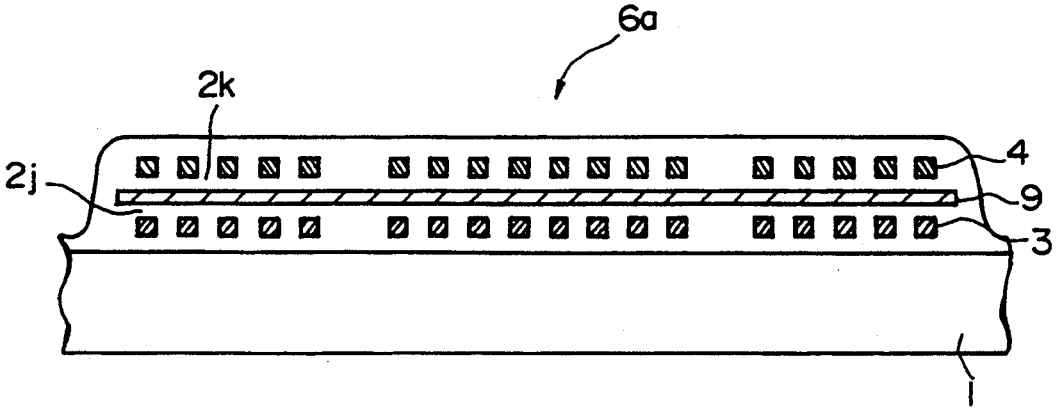
FIG. 8 is a cross-sectional view showing the major parts of the integrated thin film transformer in embodiment 6 of the present invention.

FIG. 8 shows the structure of an integrated thin film transformer in embodiment 6 of the present invention. The structure of the integrated thin film transformer in this embodiment is similar to the structure of the integrated thin film transformer 5*a* in embodiment 5, in both of which like parts are assigned like numerals, and their details and redundant descriptions are not repeated here.

In FIG. 8, what is different in the integrated thin film transformer 6*a* from the thin film transformer 5*a* in embodiment 5 is the magnetic material layer. In the integrated thin film transformer 6*a*, a magnetic material layer 9 is formed between the primary coil 3 and the secondary coil 4, with silicon dioxide layers 2*j* and 2*k*.

In the integrated thin film transformer 6*a* structured as shown in FIG. 8, an effect similar to that brought about by the integrated thin film transformer 5*a* of embodiment 5 can be obtained by the use of the magnetic material layer 9.

In the embodiments 1 and 6, what is disclosed is the integration of four identical-sized thin film transformers on the same substrate. In the present invention, the number of individual thin film transformers integrated to provide a single thin film transformer is not limited to this number, but may be 3 or less or 5 or more.

Embodiment 7

Figure 9A:
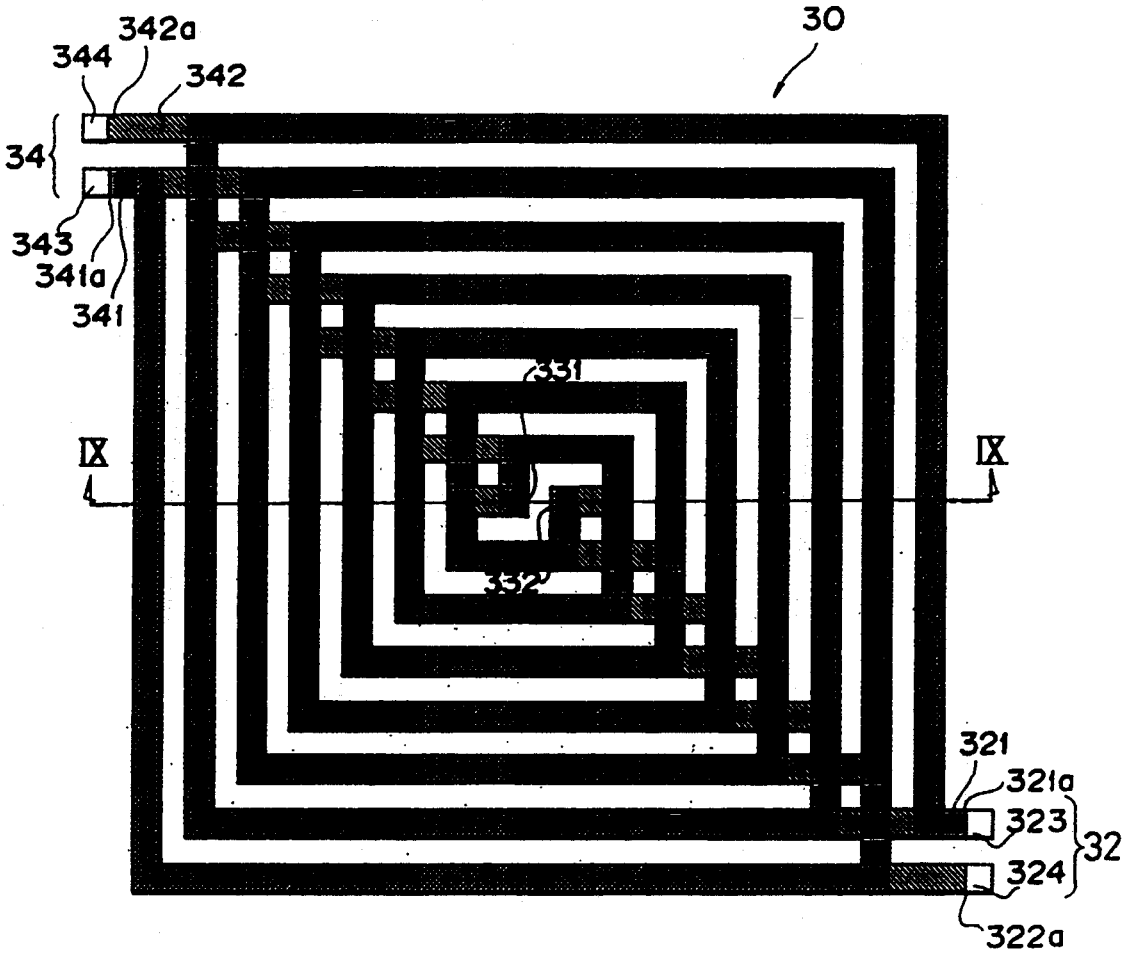
FIG. 9A is a plan view showing the coil pattern of the thin film transformer in embodiment 7 of the present invention.
Figure 9B:
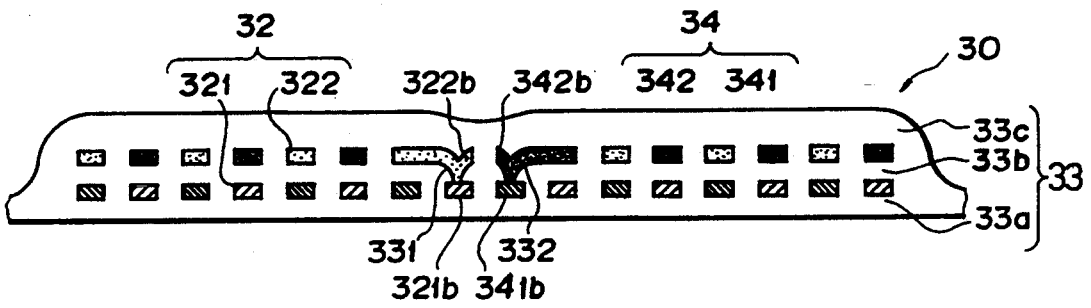
FIG. 9B is a cross-sectional view taken along the line IX—IX in FIG. 9A.
Figure 10A:
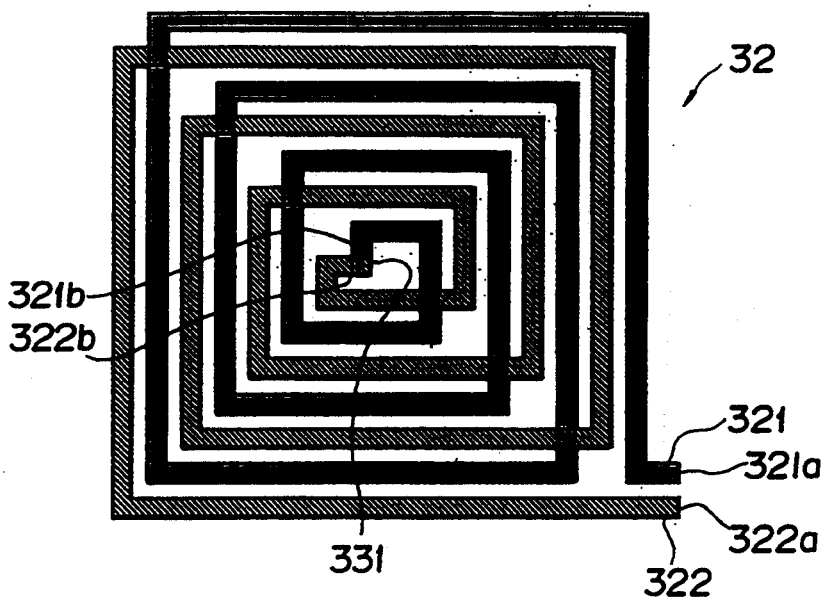
FIG. 10A is a plan view showing the coil pattern of the first thin film coil of the thin film transformer shown in FIGS. 9A and 9B.
Figure 10B:
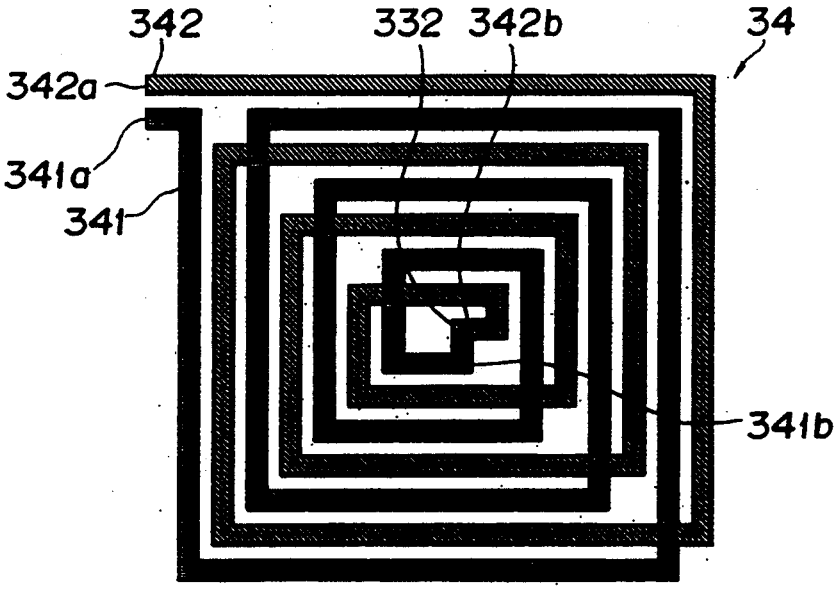
FIG. 10B is a plan view showing the coil pattern of the second thin film coil.
Figure 11A:
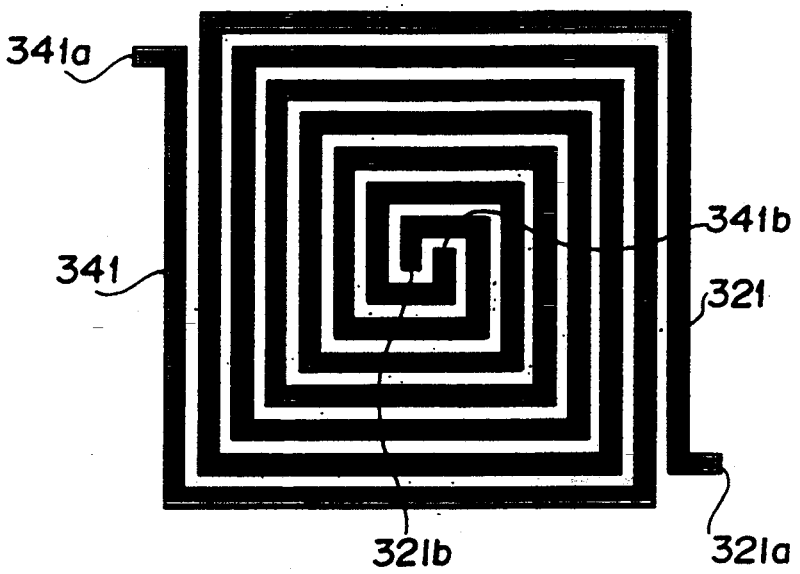
FIG. 11A is a plan view showing the spiral pattern of the lower-layer coil parts of the thin film transformer shown in FIGS. 9A and 9B.

Now, referring to FIGS. 9A and 9B, FIGS. 10A and FIGS. 10B, and FIGS. 11A and 11B, what will be explained is the thin film transformer of embodiment 7 of the present invention. In this embodiment, as a thin film transformer apparatus to which the first measure of the present invention is applied, a first thin film coil consists of two units, a first coil part and a second coil part, and a second thin film coil also consists of two units, a third coil part and a fourth coil part. FIG. 9A is a plan view showing the coil pattern of the single thin film transformer in this embodiment, and FIG. 9B is a cross-sectional view taken along the line IX—IX in FIG. 9A. FIG. 10A is a plan view showing the coil pattern of the first thin film coil forming the thin film transformer of this embodiment, and FIG. 10B is a plan view showing the coil pattern of the second thin film coil. FIG. 11A is a plan view showing the spiral pattern of the lower-layer coil parts (the first coil part and the third coil part) of the thin film transformer of this embodiment, and FIG. 11B is a plan view showing the spiral pattern of the upper-layer coil parts (the second coil part and the fourth coil part).

As shown in FIGS. 9A and 9B, a thin film transformer 30 includes a first thin film coil 32 which consists of aluminum (conductive material) formed above the surface of a substrate. The first thin film coil 32 has a thickness of from 1 to 3 μm and the width of its segments ranges from 10 to 200 μm. A second thin film coil 34 which also consists of aluminum (conductive material) is provided within an insulation body 33 which insulates it from the first thin film coil 32. The second thin film coil 34 has a thickness of from 1 to 3 μm and the width of its segments ranges from 10 to 200 μm. The first thin film coil 32 and the second thin film coil 34 have identical shapes, thicknesses, and coil gaps which maintain clearance between conductive material parts. The first thin film coil 32 has a first coil part 321 and a second coil part 322. The first coil part 321 consists of conductive material shaped in a spiral within the insulation body 33, with a designated gap between adjacent coil segments, and has a terminal 323 at the end of its outermost turn or loop 321*a*. The second coil part 322 also consists of conductive material shaped in a spiral within the insulation body 33 and has a designated gap between adjacent coil segments. The end of the inner loop 322*b* of second coil part 322 is connected electrically to the end of the inner loop of the first coil part 321 through a connection hole 331 formed in the insulation body 33, and a terminal 324 is provided at the end of the outermost loop 322*a* of the second coil part 322. On the other hand, the second thin film coil 34 has a third coil part 341 and a fourth coil part 342. The third coil part 341 consists of conductive material shaped in a spiral within the insulation body 33. The third coil part 34 has a designated gap between adjacent coil segments, and has a terminal 343 at the end of its outermost loop 341*a*. The fourth coil part 342 consists of conductive material shaped in a spiral within the insulation body 33. The fourth coil part 342 has a designated gap between adjacent coil segments, and the end of the inner loop 342*b* is connected electrically to the end of the inner loop 341*b* of the third coil part 341 through a connection hole 332 formed in the insulation body 33. A terminal 344 is provided at the end of the outermost loop 342*a* of the fourth coil part 342.

Figure 11B:
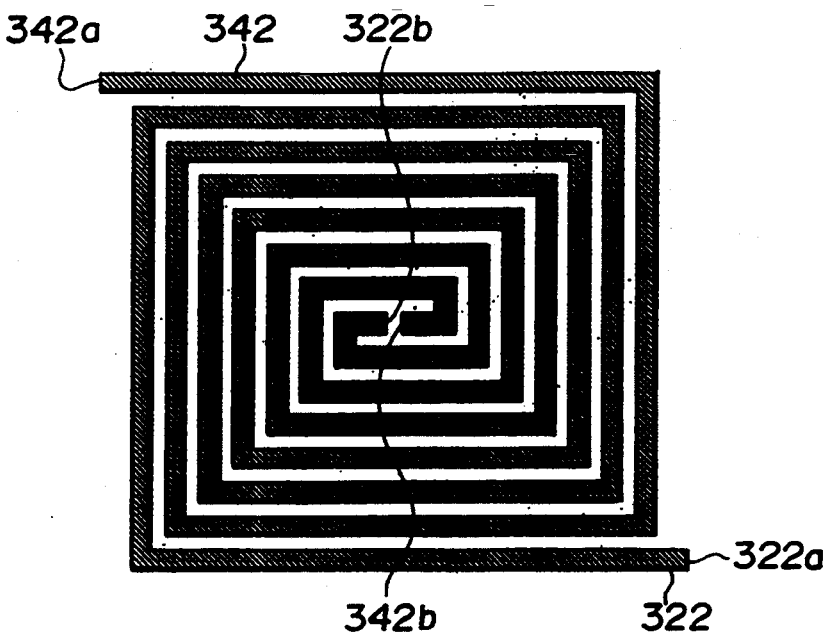
FIG. 11B is a plan view showing the spiral pattern of the upper-layer coil parts of the thin film transformer shown in FIGS. 9A and 9B.

As shown in FIG. 11A, the first coil part 321 and the third coil part 341 are formed separately in the lower part of the insulation body 33, and as shown in FIG. 11B, the second coil part 322 and the fourth coil part 342 are formed separately in the upper part of the insulation body 33. However, as shown in FIG. 10A, the end 321*b* of the inner loop of the first coil part 321 and the end 322*b* of the inner loop of the second coil part 322 are connected electrically to each other through the connection hole 331 formed in the insulation body 33, so the first coil part 321 and the second coil part 322 are connected electrically in series to provide the first thin film coil 32. Similarly, in the second thin film coil 34 as shown in FIG. 10B, the end 341*b* of the inner loop of the third coil part 341 and the end 342*b* of the inner loop of the fourth coil part 342 are connected electrically to each other through the connection hole 332 formed in the insulation body 33, so the third coil part 341 and the fourth coil part 342 are connected electrically in series. As shown in FIGS. 10A and 10B, the first thin film coil 32 and the second thin film coil 34 are formed so as to have identical spiral patterns, and their configurations are such that the first thin film coil 32 and the second thin film coil 34 would overlap each other if one film coil were rotated with respect to the other around an imaginary center line through transformer 30. As for the configurations of the first thin film coil 32 and the second thin film coil 34, since their spiral patterns are identical to each other, as shown in FIG. 9A, their overlapping area is maximized.

The thin film transformer 30 formed in the above manner is fabricated using the following process.

At first, as shown in FIG. 9B, a silicon dioxide insulation layer 33*a* having a thickness of from 0.1 to 2 μm is formed on a substrate consisting of silicon material. Next, an aluminum layer having a thickness of from 1 to 3 μm is formed on the surface of the insulation layer 33*a*, and next, the first coil part 321 and the third coil part 341 are formed as aluminum wiring lines having a width of from 10 to 200 μm by lithographic and etching processing.

And next, a silicon dioxide insulation layer 33*b* having a thickness of from about 0.1 to 2 μm is formed on the surface of the coil parts 321 and 341.

And next, the connection holes 331 and 332 are formed to expose the end 321*b* of the inner loop of the first coil part 321 and the end 341*b* of the inner loop of the third coil part 341.

And next, an aluminum layer having a thickness of from 1 to 3 μm is formed on the surface of the insulation layer 33*b*, and by lithographic and etching processing the second coil part 322 and the fourth coil part 342 as shown in FIG. 11B are formed. The aluminum wiring lines of these coil parts have a width of from 10 to 200 μm. The end 321*b* of the inner loop of the first coil part 321 and the end 322*b* of the inner loop of the second coil part 322 are connected electrically to each other through the connection hole 331 in the insulation body 33, so that the first coil part 321 and the second coil part 322 are connected in series to form the first thin film coil 32. The end 341*b* of the inner loop of the third coil part 341 and the end 342*b* of the inner loop of the fourth coil part 342 are connected electrically to each other through the connection hole 332 in the insulation body 33, so that the third coil part 341 and the fourth coil part 342 are connected in series to form the second thin film coil 34.

A silicon dioxide insulation layer 33*c* having a thickness of about between 0.1 and 2 μm is then formed on the surface of the first and second thin film coils 32 and 34. In the insulation layer 33*c*, connection holes are formed, corresponding to the terminal 321*a* of the outer loop of the first coil part 321, the terminal 322*a* of the outer loop of the second coil part 322, the terminal 341*a* of the outer loop of the third coil part 341, and the terminal 342*a* of the outer loop of the fourth coil part 342, thereby providing transformer terminals 323, 324, 343 and 344, respectively.

In the thin film transformer 30, since the first coil part 321 and the second coil part 322 are connected to each other at the ends 321*b* and 322*b* of their inner loops to provide the first thin film coil 32, and the third coil part 341 and the fourth coil part 342 are connected to each other at the ends 341*b* and 342*b* of their inner loops to provide the second thin film coil 34, the terminals 323, 324, 343 and 344 are located at the outer loops of the coils. Therefore, there are no terminals at the inner loops of the coils, where the intensity of the magnetic flux generated by the thin film transformer 30 is highest, so there is no need for connecting wires for supplying electric power to such inner terminals and the external magnetic field, if any, developed by the current running in connecting wires for supplying electric power could not disturb the generic magnetic field formed by the first thin film coil 32 and the second thin film coil 34. And also, even in the case where a thin film transformer apparatus is formed by integrating a plurality of thin film transformers 30 arranged in a one-dimensional array on the substrate, by using terminals 323, 324, 343 and 344 placed at the outer loops of the coils, the components of the thin film coils of the individual thin film transformer 30 can be used directly for connecting wires for leading electric power to the coils. Therefore, since wiring can be prepared without wire bonding, an integrated thin film transformer can be fabricated inexpensively in a simplified process.

The spiral patterns used for the first coil part 321, the second coil part 322, the third coil part 341 and the fourth coil part 342 are identical to each other with respect to their wiring width and gap, and hence, the first thin film coil 32 and the second thin film coil 34 are formed with an identical spiral pattern and their configurations are such that the first thin film coil 32 and the second thin film coil 34 would overlap each other if they were rotated with respect to each other around an imaginary center line through the thin film transformer 30. Therefore, since the configurations and spiral patterns of the first thin film coil 32 and the second thin film coil 34 are identical to each other and their overlapping area is maximized, the magnetic field coupling efficiency between the first thin film coil 32 and the second thin film coil 34 is relatively high.

Embodiment 8

Figure 12A:
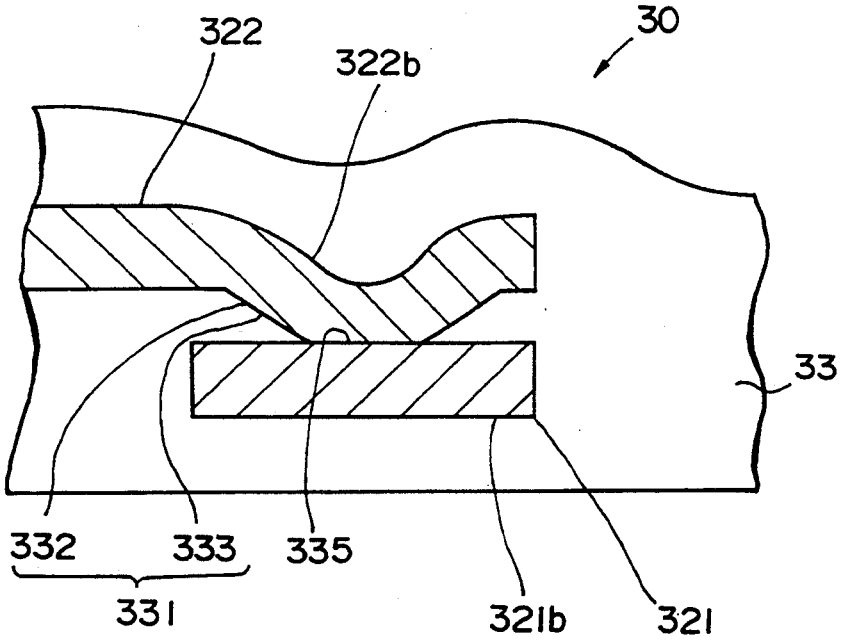
FIG. 12A is a cross-sectional view showing the structure around the connection hole of the thin film transformer in embodiment 8 of the present invention.

Now, referring to FIG. 12A, what is disclosed is a portion of a thin film transformer in accordance with embodiment 8 of the present invention. The thin film transformer in this embodiment is a modification of the thin film transformer in embodiment 7, and its difference from embodiment 7 relates to how the ends of the inner loop of the first coil part and the inner loop of the second coil part are connected in the first thin film coil, and to how the ends of the inner loop of the third coil part and the inner loop of the fourth coil part are connected in the second thin film coil. The connection structures for these two connections are similar. Therefore, in FIG. 12A, what is shown is the connection structure of the ends of the inner loop of the first coil part and the inner loop of the second coil part of the first thin film coil. In addition, the other parts of major components of the thin film transformer in this embodiment have almost the same structure as the thin film transformer in embodiment 7, and like parts are assigned like numerals and redundant explanations of them is not presented here.

In the thin film transformer 30 in this embodiment, as shown in FIG. 12A, the connection hole formed in the insulation body 33 for connecting the end 321*b* of the inner loop of the first coil part 321 and the end 322*b* of the inner loop of the second coil part 322 has a tapered shape 333 in which the cross-section of the inner side wall 332 gradually increases from its lower-layer side to its upper-layer side.

Figure 12B:
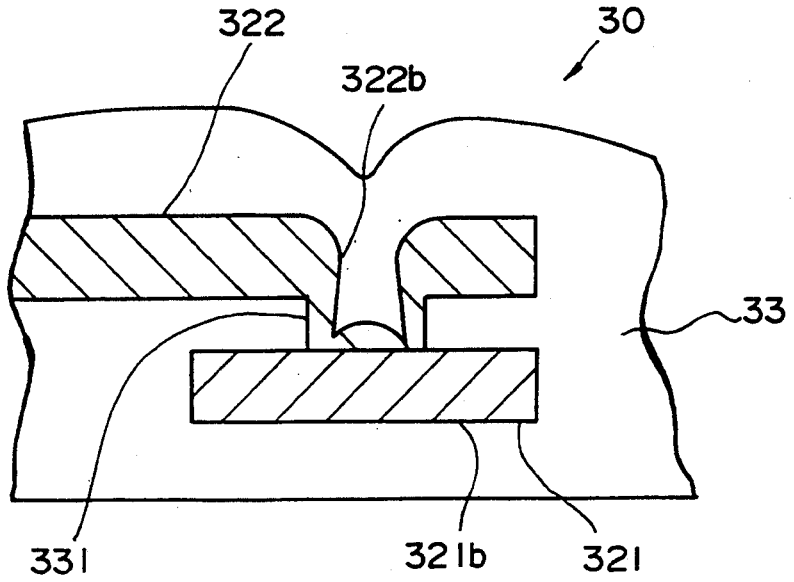
FIG. 12B is a cross-sectional view showing another structure around the connection hole of another thin film transformer for comparison.

In FIG. 12B, for comparison, what is shown is the ordinary and conventional shape of the end 321*b* of the inner loop of the first coil part 321 and the end 322*b* of the inner loop of the second coil part 322, which are connected to each other by way of a connection hole 331 which is not shaped in a taper. In the connection structure shown in FIG. 12B, when the second coil 322 is formed by sputtering or vacuum deposition, the thickness of the second coil 322 formed at the side wall part and the bottom part of the connection hole 331 is reduced by about 20% to 30% in comparison with the connection structure shown in FIG. 12A. In contrast, in the connection structure of this embodiment, shown in FIG. 12A, the thickness of the second coil part 322 at both of the inner side wall 332 and the bottom part 335 of the connection hole 331 is almost the same as the thickness of the second coil 331 away from the connection hole 331.

Therefore, in the thin film transformer 30 of this embodiment, there is no thin part found in the second coil part 322, the resistance of the second coil is kept low, and hence, the overall resistance of the transformer can be reduced.

In shaping the connection hole 331 in a taper, it is desirable to use a combination of gases, for example, $CF_4$ and $O_2$, for an etching gas in a dry etching process for the insulation body 33. In the conventional process for forming a connection hole, aluminum is used for the conductive material for forming the conductive lower-layer and upper-layer patterns, which have a wiring width of 10 μm and a wiring thickness of 2 μm, and if the contact area between the lower layer and the upper layer is made to be 100 $\mu m^2$, the inner diameter of the connection hole 311 would be about 5 μm. If the thickness of the insulation between the top and bottom aluminum layers is made to be 1 μm, if an anisotropic etching process is used, and if the thickness of the aluminum layers away from the connection hole is from 1.5 to 2 μm, then the thickness of the aluminum layer formed inside the connection hole would be at most 0.6 μm. In contrast, as shown in FIG. 12A, in this embodiment, if an isotropic etching process is used, the contact area between the lower-layer and the upper-layer is about 5 μm wide at the bottom of the connection hole 331 and about 9 μm wide at the top of the connection hole 331, with the connection hole having a taper with about a 30 degree central angle. Therefore, the thickness of the upper aluminum conductive layer (the second coil 322) can be kept between about 1.5 μm and 2 μm from the region away from the connection hole 331 and to the tapered part inside the connection hole 331. As a result, since the resistance of the aluminum layer (the second coil part 322) inside the connection hole 331 can be reduced by about ⅓ in comparison with a transformer with a conventional connection structure as shown in FIG. 12B, the resistance loss of the thin film transformer can be reduced remarkably.

Embodiment 9

Figure 13A:
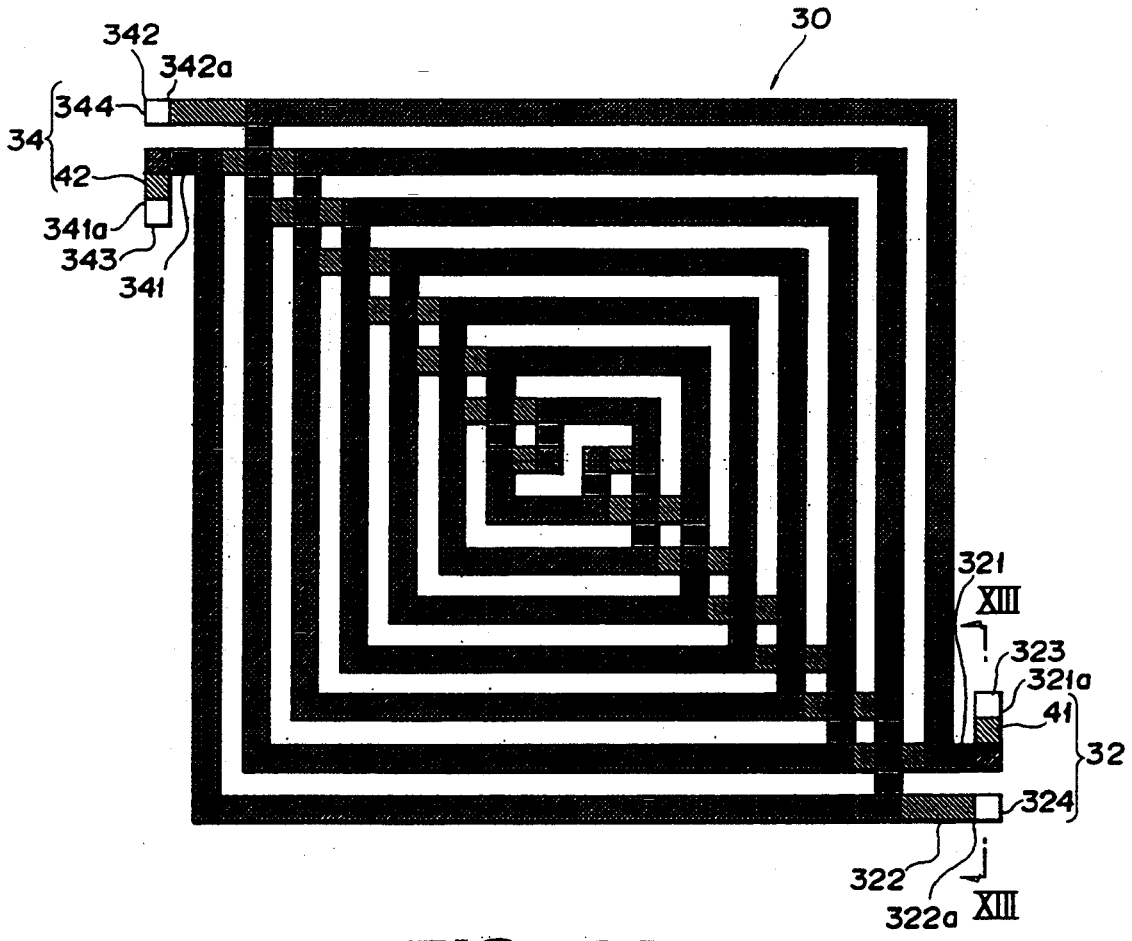
FIG. 13A is a plan view showing the spiral pattern of the thin film transformer in embodiment 9 of the present invention.
Figure 13B:
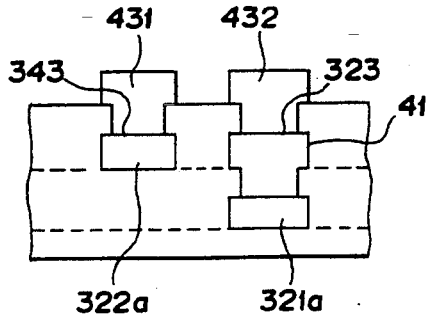
FIG. 13B is a cross-sectional view taken along the line XIII—XIII in FIG. 13A.

Now, referring to FIGS. 13A and 13B, what is disclosed is a thin film transformer in accordance with embodiment 9 of the present invention. The thin film transformer in this embodiment is a modification of the thin film transformer in embodiment 7, and its differences relate to the connection structure at the end of the outer loop of the first coil part to the connection structure at the end at the inner loop of the third coil part. Therefore, the major components except the connection structures of the thin film transformer in this embodiment have almost the same structure as the thin film transformer in embodiment 7, and like parts are assigned like numerals and redundant explanations of them will not be presented here.

FIG. 13A is a plan view showing the spiral pattern of the thin film transformer in embodiment 9 of the present invention, and FIG. 13B is a cross-sectional view taken along line XIII—XIII.

In FIGS. 13A and 13B, in the thin film transformer 30, after the first coil part 321 and the third coil part 341 have been formed from the lower aluminum layer and after they have been covered with an insulation layer, the connection hole 331 is formed in the insulation layer and furthermore the end 321*a* of the outer loop of the first coil part 321 and the end 341*a* of the outer loop of the third coil part 341 are exposed. Then the upper aluminum layer is deposited and the second coil part 322 and the fourth coil part 342 are fabricated from it. A stand-up conductive layer 41 on the end 321*a* of the outer loop of the first coil part 321 and a stand-up conductive layer 42 on the end 341*a* of the outer loop of the third coil part 341 are also left, the stand-up conductive layers being insulated from the second and fourth coil parts 322 and 342. As a result, as shown in FIG. 13B, which illustrates a cross-sectional view around the end 321 of the outer loop of the first coil part 321, the stand-up conductive layer 41 is contained in the same layer as the end 322*a* of the outer loop of the second coil part 322, and bump electrodes 431 and 432 which are free from discontinuous gaps and shapes can be formed to provide the eventual terminal ends.

As described above, in the thin film transformer 30 of this embodiment, since the bump electrodes 431 and 432 do not contain discontinuous gaps and shapes when they are used in a connection structure, it will be appreciated that reliable and uniform wiring patterns can be established. In addition, since there is no need for preparing extra processing or apparatus, the reliability of the connection parts can be increased without sacrificing economy while manufacturing thin film transformers. Even in this embodiment, the connection hole may be shaped in a taper as described in embodiment 8 in order to prevent a reduction in the thickness of the wiring in the upper aluminum layer for forming the coils.

Embodiment 10

Figure 14:
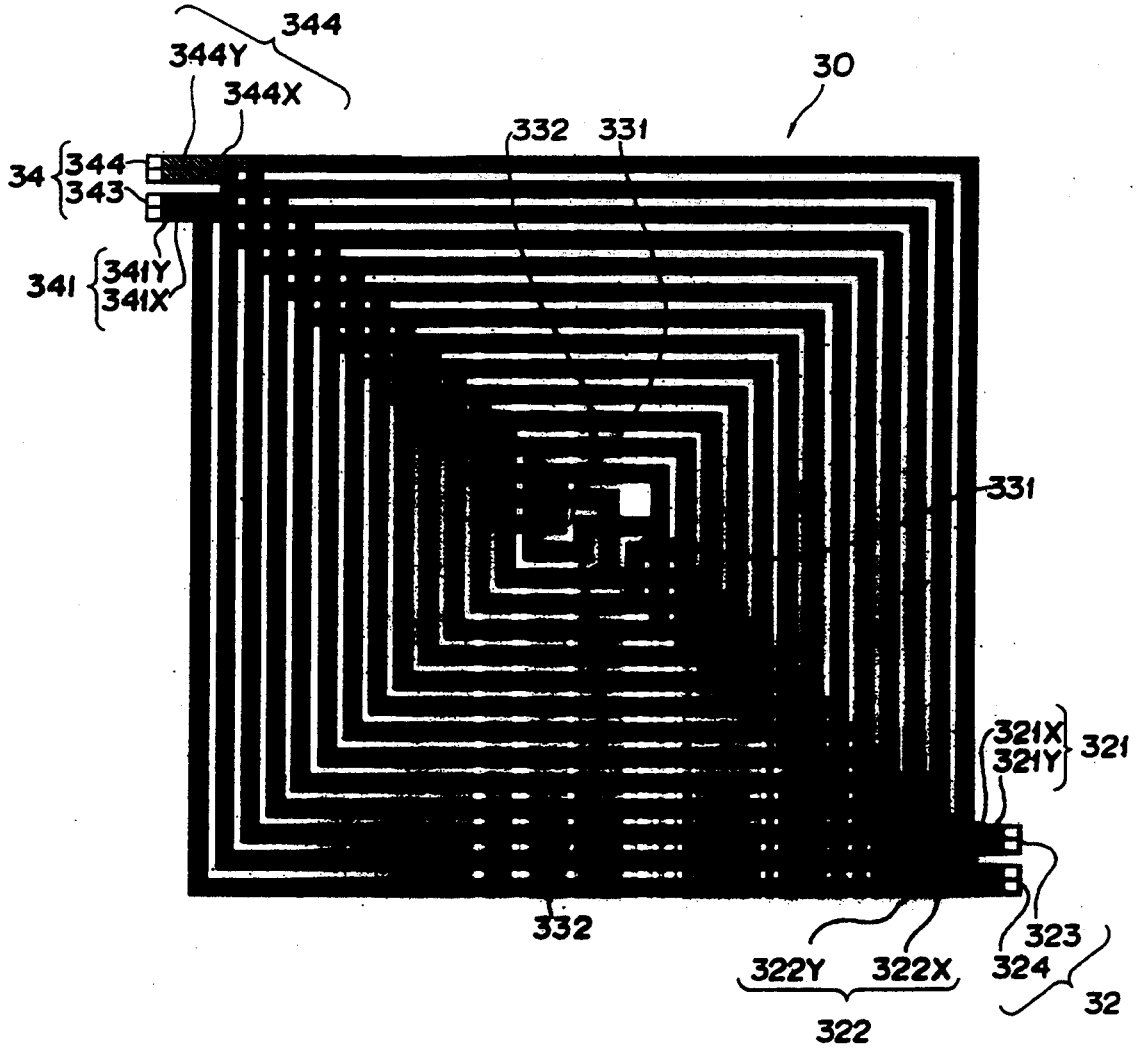
FIG. 14 is a plan view showing the spiral pattern of the thin film transformer in embodiment 10 of the present invention.
Figure 15A:
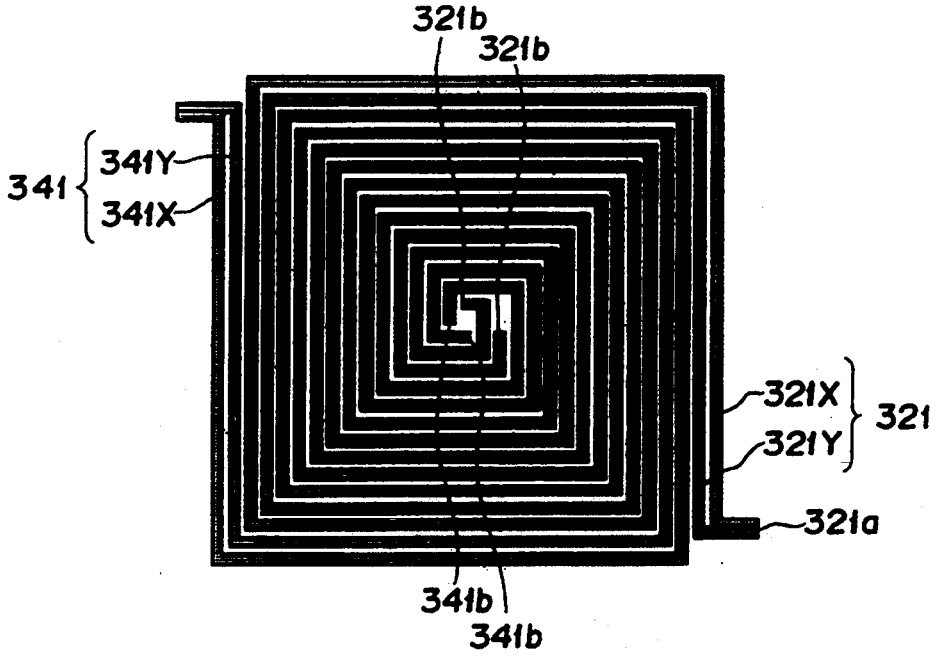
FIG. 15A is a plan view showing the spiral pattern of the lower-layer coil parts forming the thin film transformer shown in FIG. 14.
Figure 15B:
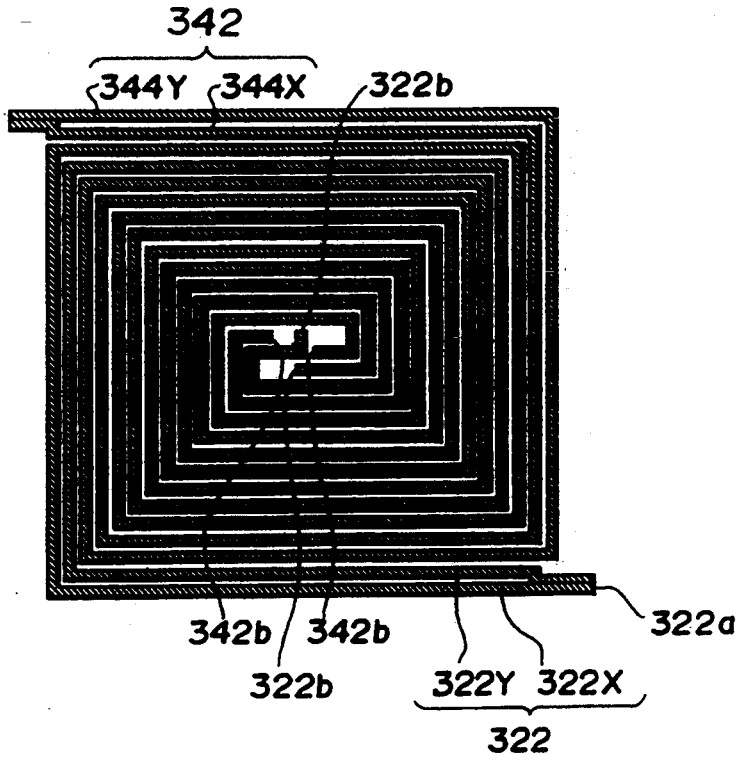
FIG. 15B is a plan view showing the spiral pattern of the upper-layer coil parts forming the thin film transformer shown in FIG. 14.

Now, referring to FIG. 14 and FIGS. 15A and 15B, what is disclosed is a thin film transformer in embodiment 10 of the present invention. The thin film transformer in this embodiment is a modification of the thin film transformer in embodiment 7, and its differences relate to the structure of the coils included in the first thin film coil and the second tin film coil. Therefore, the major components except the structure of the coils in this embodiment have almost the same structure as the thin film transformer in embodiment 7, and like parts are assigned like numerals and redundant explanations are not presented here.

FIG. 14 is a plan view showing the spiral pattern of the thin film transformer in embodiment 10 of the present invention.

FIG. 15A is a plan view showing the spiral pattern of the lower-layer coil part forming the thin film transformer shown in FIG. 14, and FIG. 15B is a plan view showing the spiral pattern of the upper-layer coil part of it.

In FIGS. 14, 15A and 15B, in the thin film transformer 30 of this embodiment, what are formed on the surface of the substrate are the first thin film coil 32 and the second thin film coil 34. The first thin film coil 32 and the second thin film coil 34 have identical shapes, thicknesses, and coil gaps which maintain an allowable clearance between conductive material parts. The first thin film coil 32 has the first coil part 321 and the second coil part 322. The first coil part 321 consists of conductive material shaped in a spiral above the surface of the substrate 31 within the insulation body 33, with a designated gap between adjacent coil segments, and has a terminal 323 at the end of its outermost loop 321*a*. The second coil part 322 consists of conductive material shaped in a spiral within the insulation body 33, with a designated gap between adjacent coil segments, and the end of the inner loop 322*b* is connected electrically to the end of the inner loop of the first coil part 321 through the connection hole 331 formed in the insulation body 33. A terminal 324 is defined at the end of the outermost loop 322*a* of the second coil part 322. On the other hand, the second thin film coil 34 has the third coil part 341 and the fourth coil part 342. The third coil part 341 consists of conductive material shaped in a spiral above the substrate and within the insulation body 33, with a designated gap between adjacent coil segments, and has a terminal 343 at the end of its outermost loop 341*a*. The fourth coil part 342 consists of conductive material shaped in a spiral within the insulation body 33, with a designated gap between adjacent coil segments, and the end of the inner loop 342*b* is connected electrically to the end of the inner loop 341*b* of the third coil part 341 through the connection hole 332 formed in the insulation body 33. A terminal 344 is provided at the end of the outermost loop 342*a* of the fourth coil part 342.

In the thin film transformer 30 of this embodiment, the first coil part 321 and the second coil part 322 forming the first thin film coil 32 consist of two pairs of conductive portions 321*x*, 321*y*, 322*x* and 322*y*, each pair having an identical wiring width and gap and, in each pair, the conductive portions are connected electrically in parallel. Suppose that the ratio of the wiring width to the wiring gap in the spiral pattern of the thin film coil of embodiment 7 is 1:1 and that the ratio of the wiring width to the wiring gap in the spiral pattern of the thin film coil of this embodiment is 0.5:0.5, in which case the area of each coil in this embodiment is the same.

In the thin film transformer 30 formed in the above described structure, since the pitch of the spiral pattern is the same as that of embodiment 7, the direct-current resistance of the coil is not improved, that is, not reduced, but the overall surface area of the coil parts is increased due to multiple pairs of conductive portion, and therefore, the resistance in the high frequency domain is reduced. Since the electric current distribution in the high frequency domain is localized on the surface of a conductor due to the skin effect, the resistance loss of the transformer due to the skin effect can be reduced by using a coil structure in which the surface area is increased.

Embodiment 11

Figure 16:
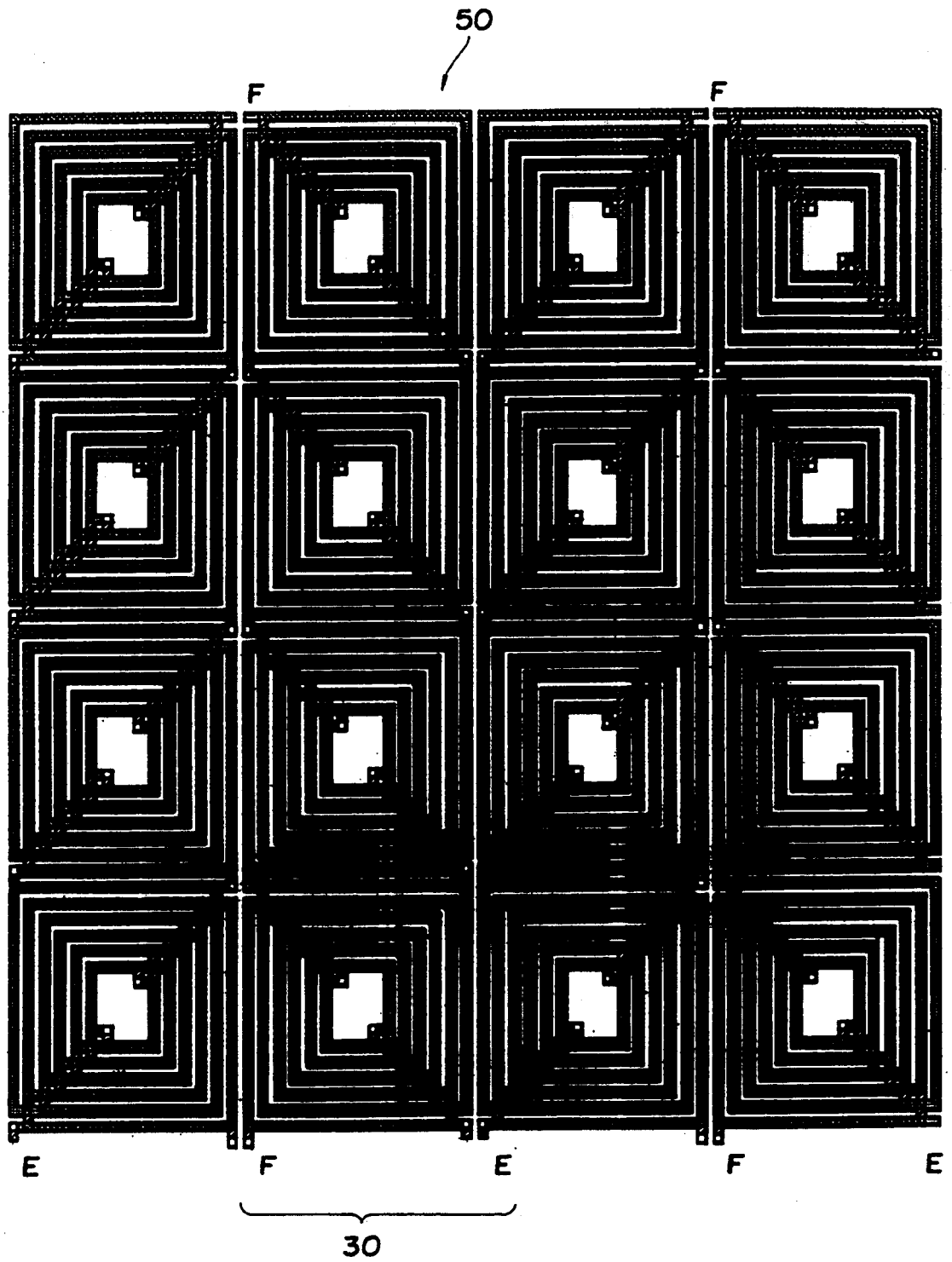
FIG. 16 is a plan view showing the overall configuration of the integrated thin film transformer in embodiment 11 of the present invention.

Now, referring to FIG. 16, what is disclosed is a thin film transformer in accordance with embodiment 11 of the present invention. FIG. 16 is a plan view showing the overall configuration of the integrated thin film transformer apparatus in embodiment 11 of the present invention. This thin film transformer apparatus is an integrated thin film transformer apparatus (a transformer apparatus using the second measure of the present invention) in which a plurality of individual thin film transformers, each consisting of a thin film transformer of embodiment 7, are arranged in a two-dimensional grid array. Therefore, like parts used in both embodiments are assigned like numerals in FIG. 15 and redundant explanations are not presented here.

In FIG. 16, the integrated thin film transformer 50 of this embodiment has a 4-by-4 matrix array layout of thin film transformers 30 of embodiment 7, with four thin film transformers being connected in series as a single group and four groups being connected in parallel. The distance between adjacent thin film transformers 30 is selected so as to be less than or equal to the wiring gaps of the first thin film coils 32 and the second thin film coils 34. The first thin film coils 32 and the second thin film coils 34 have identically shaped spiral patterns, and pairs of individual thin film transformers 30 which are adjacent to each other in the vertical direction in FIG. 16 are placed in a line symmetry with respect to a straight line extending in the horizontal direction in FIG. 16 and passing through the mid-point between these two thin film transformers 30. In addition, the thin film coils 32 in pairs of individual thin film transformers 30 adjacent to each other in the vertical direction are connected to each other, and also, the thin film coils 34 in these two thin film transformers 30 are connected to each other.

In the thin film transformer 50, since all the terminals of the thin film transformers 30 are located on the outer loops of the coils, it is easy to connect adjacent thin film transformers 30 without preparing wire bonding. In addition, since the terminals of the thin film transformer 50 itself are located outside as primary coil terminals E of the first thin film coils 32 or secondary coil terminals F of the second thin film coils 34, it is also easy to connect wiring to the thin film transformer 50.

Figure 17A:
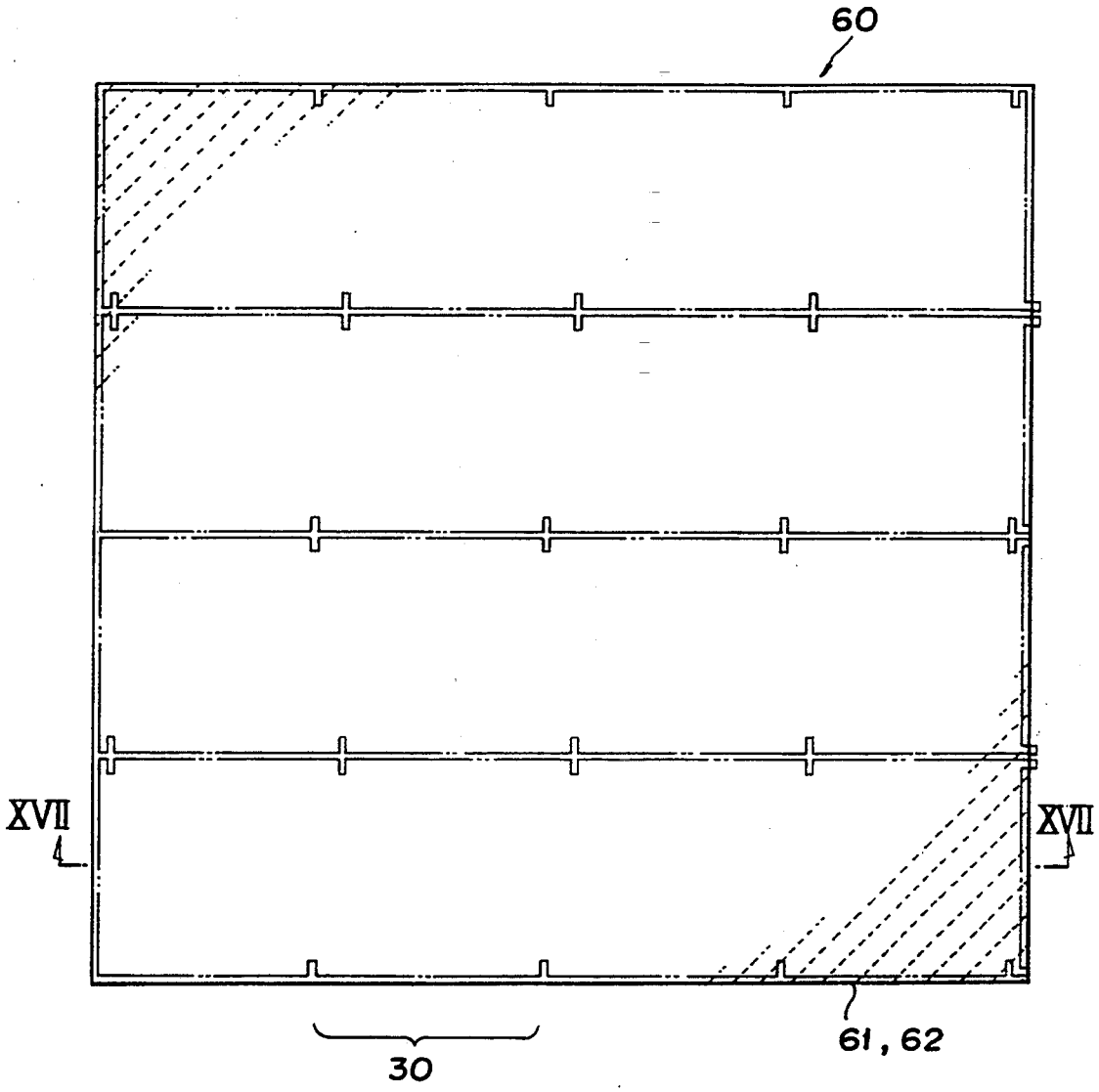
FIG. 17A is a plan view showing the layout of a single thin film transformer in a modification of the integrated thin film transformer in embodiment 11 of the present invention.
Figure 17B:
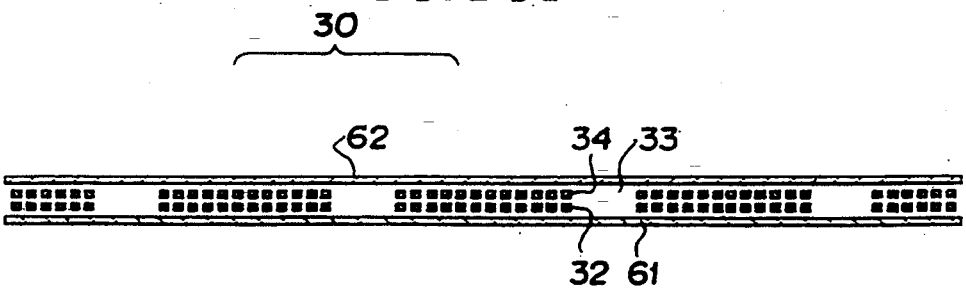
FIG. 17B is a cross-sectional view taken along the line XVII—XVII in FIG. 17A.

In FIGS. 17A and 17B, what is shown is a modification of the integrated thin film transformer 50 of embodiment 11. FIG. 17A is a plan view showing the layout of a single thin film transformer in the modification and FIG. 17B is a cross-sectional view taken along line XVII—XVII.

In FIGS. 17A and 17B, in the integrated thin film transformer apparatus 60, a lower magnetic material layer 61 is formed inside the insulation body 33 below the first thin film coil 32 and the second thin film coil 34 and an upper magnetic material layer 62 is formed inside the insulation body 33 above the thin film coils. Due to this configuration, in comparison with the integrated thin film transformer of embodiment 11, the intensity of the magnetic field developed around the coils can be enlarged, and furthermore, since the magnetic flux is captured by the lower magnetic material layer 61 and the upper magnetic material layer 62, magnetic flux leakage can be reduced, and hence, the intensity of the magnetic field can be further increased.

Embodiment 12

Figure 18A:
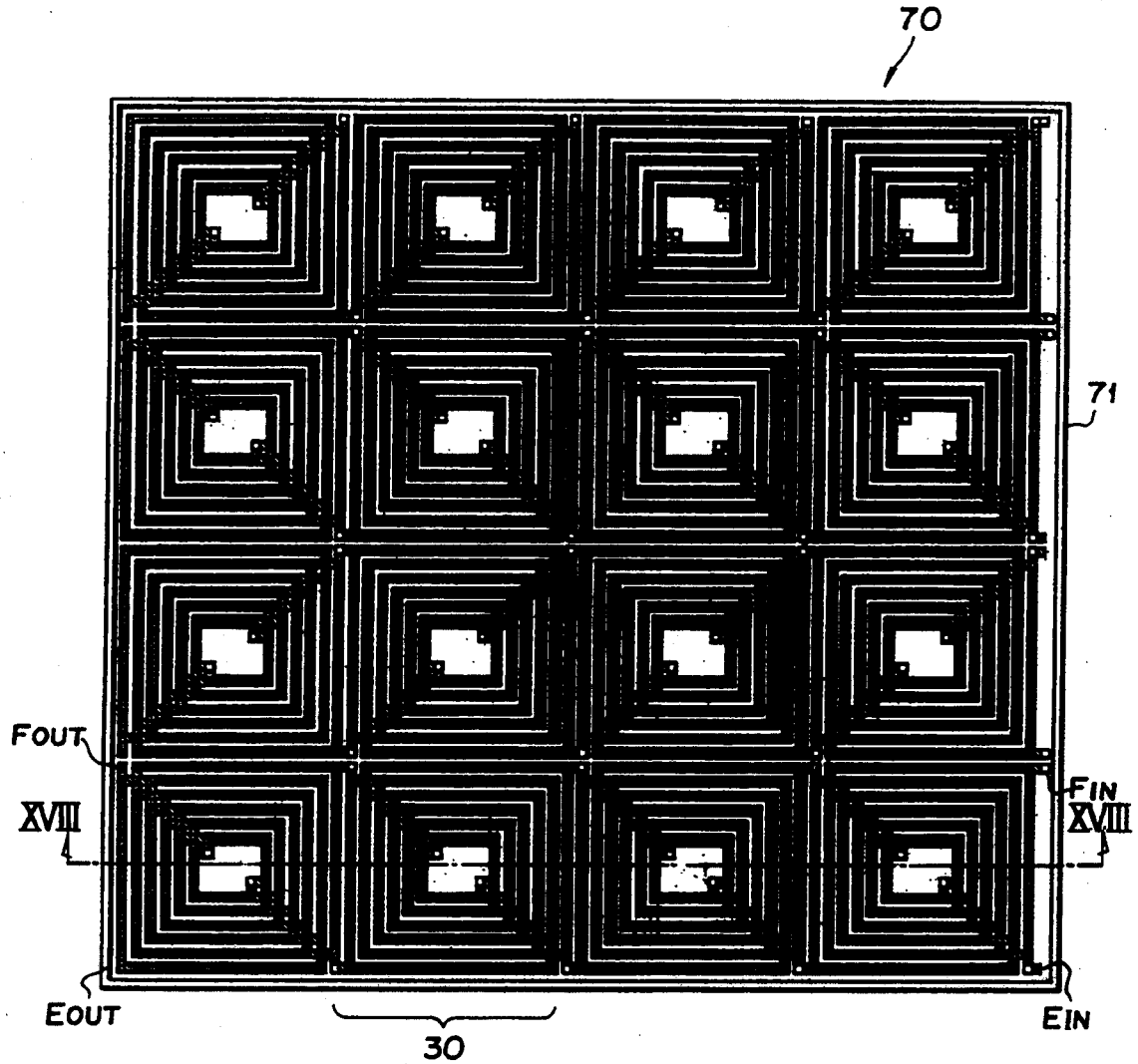
FIG. 18A is a plan view showing the structure of the integrated thin film transformer apparatus in embodiment 12 of the present invention.
Figure 18B:
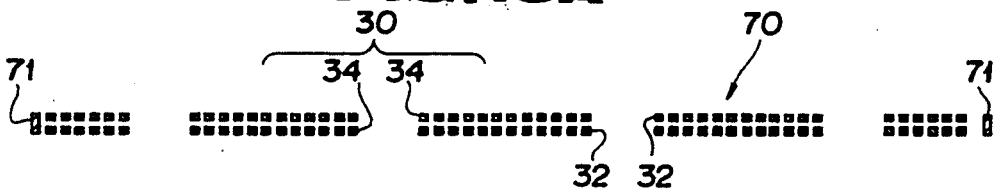
FIG. 18B is a cross-sectional view taken along the line XVIII—XVIII in FIG. 18A.
Figure 18C:
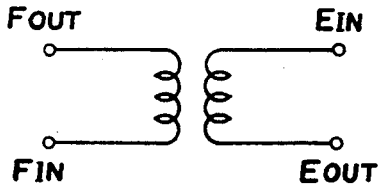
FIG. 18C is a diagram showing an equivalent circuit of the thin film transformer.

Now, referring to FIGS. 18A and 18B, what is disclosed is a thin film transformer in accordance with embodiment 12 of the present invention. FIG. 18A is a plan view showing the structure of the integrated thin film transformer apparatus in embodiment 12 of the present invention, FIG. 18B is a cross-sectional view taken along line XVIII—XVIII, and FIG. 18C is the equivalent circuit of the thin film transformer. The structure of the individual thin film transformers forming the integrated thin film transformer of this embodiment is similar to that of the thin film transformer of embodiment 7, and hence, like parts used in both embodiments are assigned like numerals and redundant explanations are not presented here.

In FIGS. 18A and 18B, in the integrated thin film transformer 70 of this embodiment, first thin film coils 32 consisting of conductive material, and second thin film coils 34 consisting of conductive material are provided within an insulation body above a substrate. The first thin film coils 32 and the second thin film coils 34 have identical shapes, thicknesses, and coil gaps, and their spiral patterns are identical to each other. The first thin film coils 32 and the second thin film coils 34 have coil parts consisting of spiral aluminum conductors with designated gaps between adjacent coil segments, and upper-layer coil parts are connected to lower-layer coil parts through connection holes formed in the insulation body at their ends of the inner loops. In this configuration, the individual thin film transformers 30 have no terminals inside their peripheries.

In the integrated thin film transformer 70 of this embodiment, four sets of four thin film transformers 30 are connected in series to form four columns which are connected in parallel. Located at the periphery of the integrated thin film transformer 70 are a primary coil terminal $E_{IN}$ and a primary coil terminal $E_{OUT}$ which are connected to the first thin film coils 32, and a secondary coil terminal $E_{IN}$ and a secondary coil terminal $E_{OUT}$ which are connected to the second thin film coils 34. The equivalent circuit is shown in FIG. 18C.

And furthermore, in the thin film transformer 70 of this embodiment, a guard ring 71 of magnetic material is placed around the thin film transformers 30.

With this layout, in the thin film transformer 70 of this embodiment, the leakage flux from the magnetic flux generated by the coils is reduced, and a coil coupling factor of about 0.99 or more can be obtained, and hence the conversion efficiency of the transformer is very high.

To make the integrated thin film transformer 70 in this embodiment, the manufacturing process for the single thin film transformers 30 is the same as in embodiment 7 and will not be repeated here, and the magnetic material guard ring 71 can be formed in the manner described below.

At first, the outermost surface of the region with the thin film transformers 30 is covered with a CVD oxide layer, and a channel pattern having a width of from 100 to 200 μm is formed 2 to 10 μm, for example, from the outer edge of the integrated thin film transformer 70 by using photolithography processing technology. In etching the channel, a relatively thick resist layer having a width of from 10 to 20 μm or a photo-sensitive polyimide layer is used, and it remains after etching processing.

Next, a magnetic material thin film is deposited by sputtering until the thickness of the film reaches from 10 to 20 μm. The magnetic material thin film cracks at the edges of the channel because the growing volume of the magnetic material thin film can not follow the shape of the edges. In the state that the magnetic material thin film is cracked, the resist and photo-sensitive polyimide layer are removed by a solvent liquid and at the same time, unnecessary magnetic material thin film is lifted off. As a result, the magnetic material thin film remains only at the bottom and inside of the channel, thus forming the magnetic material guard ring 71.

The magnetic material guard ring 71 can also be formed by the use of ordinary photo-lithography processing technology only. In this case, after covering the outermost surface of the area where the thin film transformers 30 are located with a CVD oxide layer, resist is painted on the oxide layer, and resist corresponding to the pattern for forming the magnetic material guard ring 71 is removed to provide an open channel exposing the surface of the oxide layer. By dry etching processing, the oxide layer is etched so as to form a channel in the oxide layer. And next, after removing the resist, a magnetic material thin film is formed on the whole development area. Then resist is painted again on the magnetic material thin film, and subsequently removed except for a pattern corresponding to the guard ring. The magnetic material thin film is then selectively removed by etching. As a result, the magnetic material guard ring 71 is finally established. The resist is removed, leaving the integrated thin film transformer 70 having the magnetic material guard ring 71.

Embodiment 13

Figure 19A:
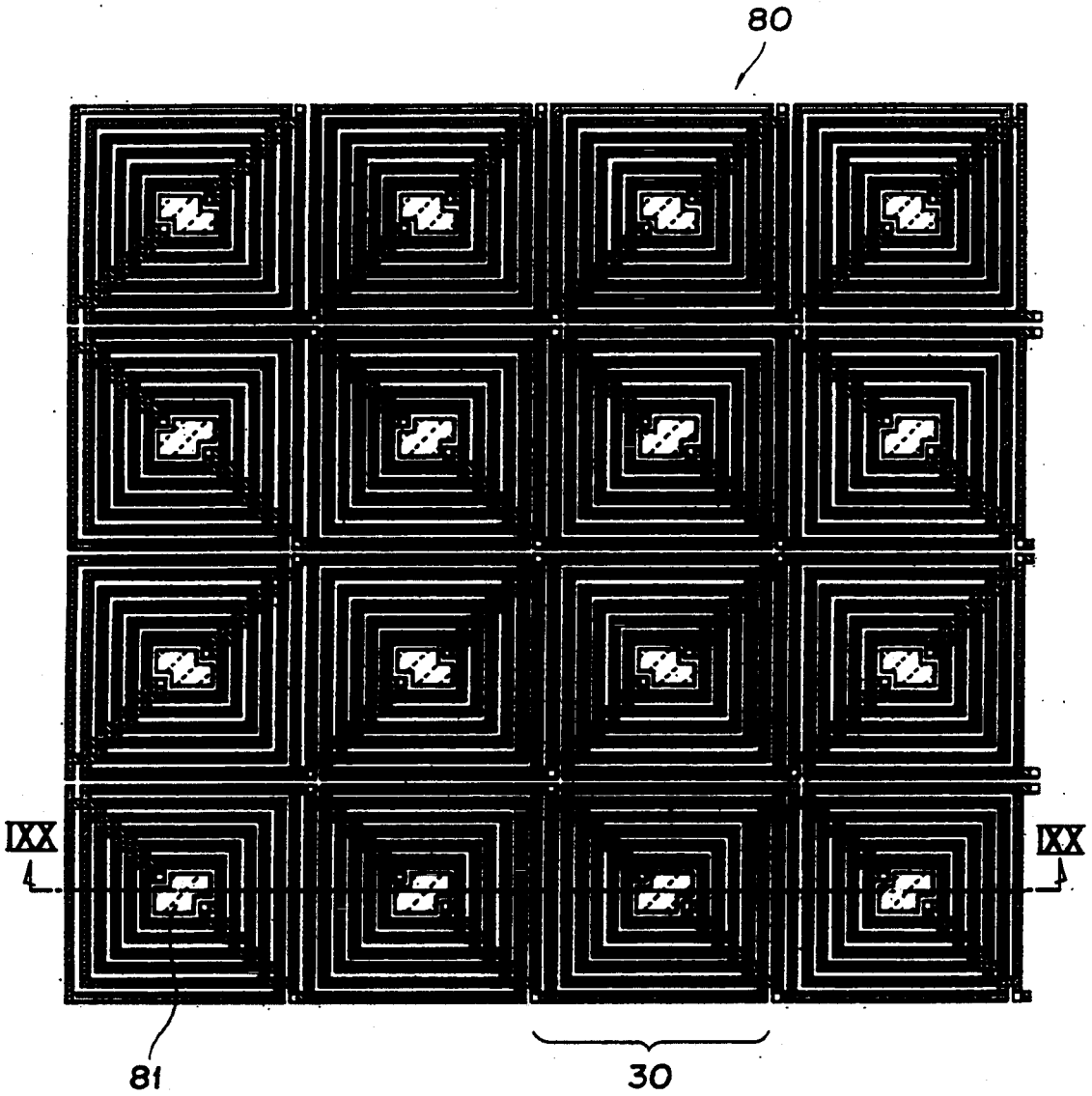
FIG. 19A is a plan view showing the structure of the integrated thin film transformer apparatus in embodiment 13 of the present invention.
Figure 19B:
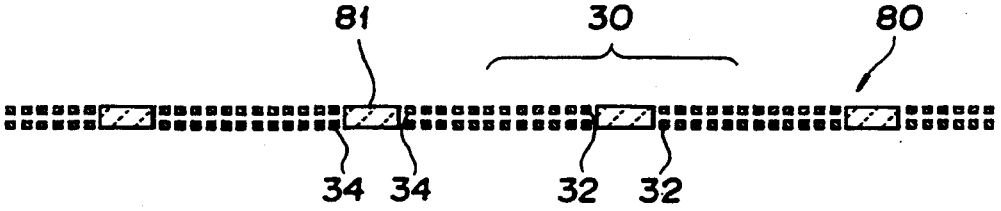
FIG. 19B is a cross-sectional view taken along the line IXX—IXX in FIG. 19A.

Now, referring to FIGS. 19A and 19B, what is disclosed is an integrated thin film transformer (assembled-type thin film transformer) in accordance with embodiment 13 of the present invention. FIG. 19A is a plan view showing the structure of the integrated thin film transformer apparatus in embodiment 13 of the present invention, and FIG. 19B is a cross-sectional view taken along line IX—IX. The structure of the individual thin film transformers forming the integrated thin film transformer of this embodiment is similar to that of the thin film transformer of embodiment 7, and hence, like parts used in both embodiments are assigned like numerals and redundant explanations will not be presented here.

In FIGS. 19A and 19B, the individual thin film transformers 30 of the integrated thin film transformer 80 of this embodiment are also formed without terminals inside the coil loops. In the integrated thin film transformer 80, magnetic material 81 is formed at the centers of the coil loops of the individual thin film transformers 30 in a process similar to that used to form the magnetic guard ring of the integrated thin film transformer of embodiment 12.

In the integrated thin film transformer 80 of this embodiment, since the magnetic resistance at the centers of the thin film transformers 30 (where the magnetic flux density is highest) is substantially reduced, the conversion efficiency of the transformer 80 is increased.

Embodiment 14

Figure 20A:
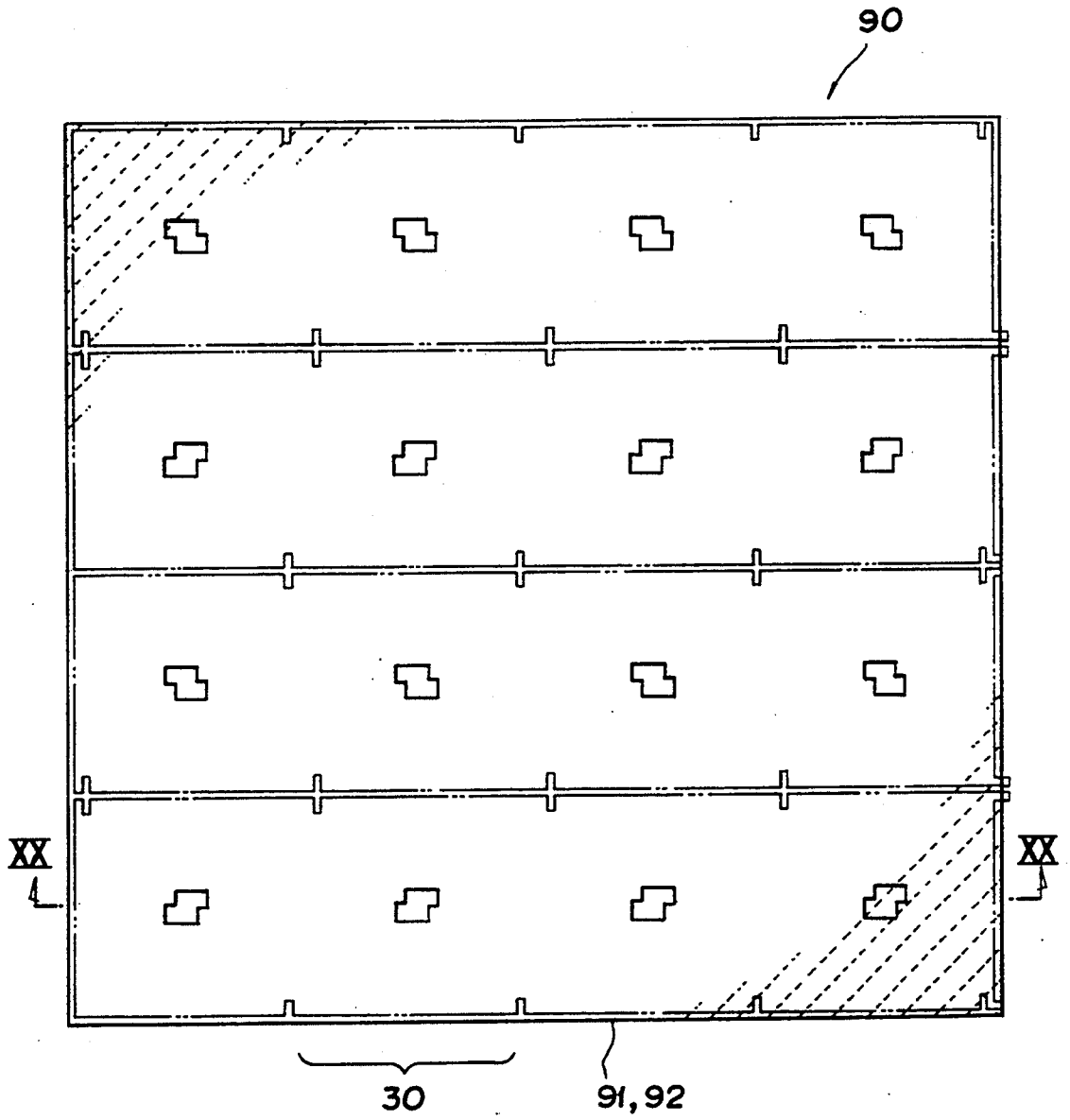
FIG. 20A is a plan view showing the structure of the integrated thin film transformer apparatus in embodiment 14 of the present invention.
Figure 20B:
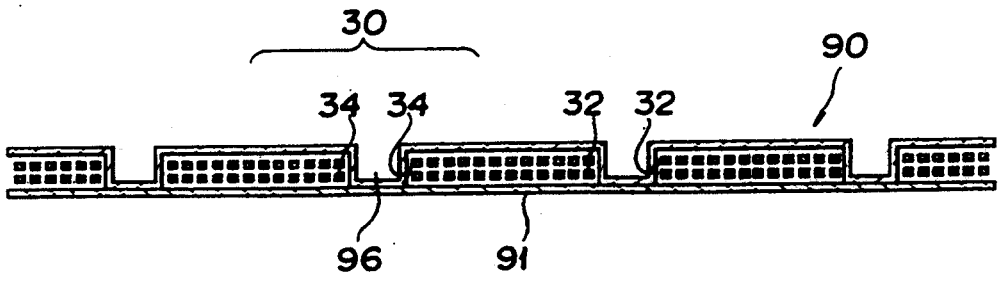
FIG. 20B is a cross-sectional view taken along the line XX—XX in FIG. 20A.

Now, referring to FIGS. 20A and 20B, what is disclosed is an integrated thin film transformer in accordance with embodiment 14 of the present invention. FIG. 20A is a plan view showing the overall structure of the integrated thin film transformer apparatus in embodiment 14 of the present invention, and FIG. 20B is a cross-sectional view taken along line XX—XX in FIG. 20A. The structure of the individual thin film transformers forming the integrated thin film transformer of this embodiment is also similar to that of the thin film transformer of embodiment 7, and hence, like parts used in both embodiments are assigned like numerals and redundant explanations will not be repeated here.

In FIGS. 20A and 20B, the individual thin film transformers 30 of the integrated thin film transformer 80 of this embodiment are also formed without terminals inside the coil loops. On the other hand, above and below the first thin film coils 32 and the second thin film coils 34, which form the thin film transformers 30, a lower magnetic material layer 91 and an upper magnetic material layer 92 are formed. Inside the area where the first thin film coil 32 and the second thin film coil 34 of each transformer 30 are provided, there is a coil gap area (where no coil segments exist) which does not contain the insulation body 31, and thus, the lower magnetic material layer 91 and the upper magnetic material layer 92 are connected to each other through a removal area 96 where no insulation material is contained.

Due to this configuration, the intensity of the magnetic field developed around the coils is enlarged. Furthermore, since the magnetic flux is captured by the lower magnetic material layer 91 and the upper magnetic material layer 92, magnetic flux leakage is reduced, and the intensity of the magnetic field can be further increased. In addition, the magnetic resistance at the center of the thin film transformers 30 (where the magnetic flux density is the highest) is substantially reduced, so the conversion efficiency of the transformer 90 is increased.

Embodiment 15

Figure 21A:
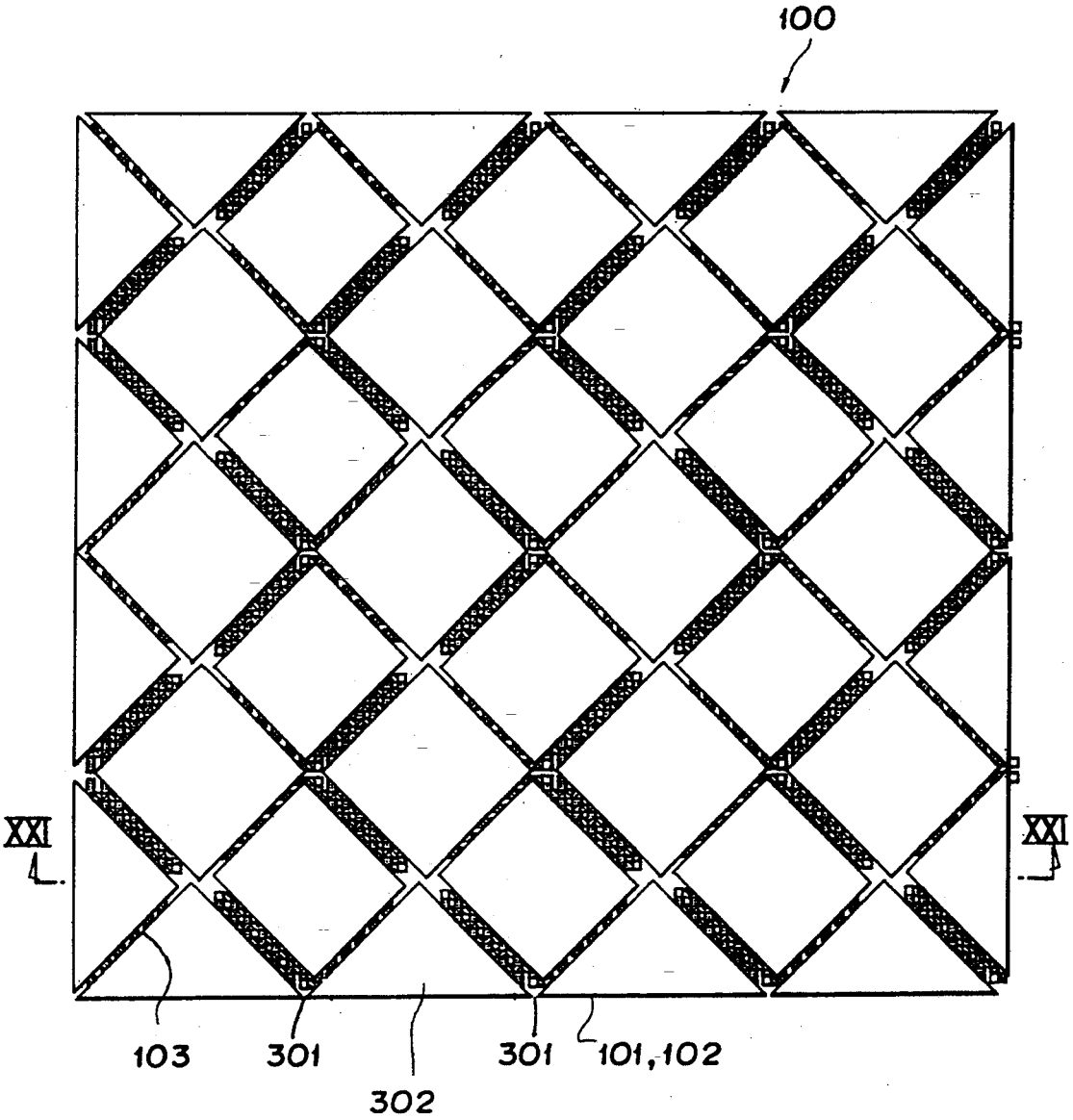
FIG. 21A is a plan view showing the structure of the integrated thin film transformer apparatus in embodiment 15 of the present invention.
Figure 21B:
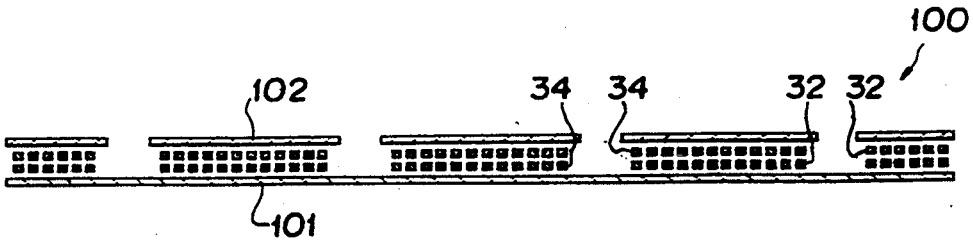
FIG. 21B is a cross-sectional view taken along the line XXI—XXI in FIG. 21A.

Now, referring to FIGS. 21A and 21B, what is disclosed is an integrated thin film transformer in accordance with embodiment 15 of the present invention. FIG. 21A is a plan view showing the overall structure of the integrated thin film transformer apparatus in embodiment 15 of the present invention, and FIG. 21B is a cross-sectional view taken along the line XXI—XXI in FIG. 21A. The structure of the individual thin film transformers forming the integrated thin film transformer of this embodiment is also similar to that of the thin film transformer of embodiment 7, and hence, like parts used in both embodiments are assigned like numerals and redundant explanations will not be repeated here.

In FIGS. 21A and 21B, the individual thin film transformers 30 of the integrated thin film transformer 100 of this embodiment are also formed without terminals inside the coil loops. On the other hand, above and below the first thin film coils 32 and the second thin film coils 34 forming the thin film transformers 30, a lower magnetic material layer 101 and an upper magnetic material layer 102 are provided. Therefore, the intensity of the magnetic field developed around the coils can be enlarged. Furthermore, since the magnetic flux is captured by the lower magnetic material layer 101 and the upper magnetic material layer 102, magnetic flux leakage can be reduced, and hence, the intensity of the magnetic field can be further increased.

And furthermore, at the lower magnetic material layer 101 and the upper magnetic material layer 102 in the integrated thin film transformer 100 of this embodiment, slits 103 are formed as a buffer for eddy currents by breaking the eddy currents. The first thin film coil 32 and the second thin film coil 34 of a thin film transformer 30 are formed so as to be shaped in plane spiral pattern in which there are four corner parts 301 in each loop or turn and four straight parts 302 between pairs of corner parts 301, and the slits 103 of the lower magnetic material layer 101 and the upper magnetic material layer 102 are formed along paths that follow the corner parts 301. Owing to this configuration, at the interior of integrated thin film transformer 100, the lower magnetic material layer 101 and the upper magnetic material layer 102 are separately shaped in squares, and the lower magnetic material layer 101 and the upper magnetic material layer 102 located near the peripheral edge are separately shaped in triangles.

In the integrated thin film transformer 100 structured as above, in spite of the fact that the magnetic material layers occupying a large area (the lower magnetic material layer 101 and the upper magnetic material layer 102) are formed under and over the individual thin film coils, the magnetic flux can easily pass through the slits 103, and energy loss due to eddy current (eddy current loss in the magnetic material) is reduced as much as possible based on the principle of a cut core transformer in which the eddy current path is broken. Hence, the conversion efficiency is very high.

Embodiment 16

Figure 22A:
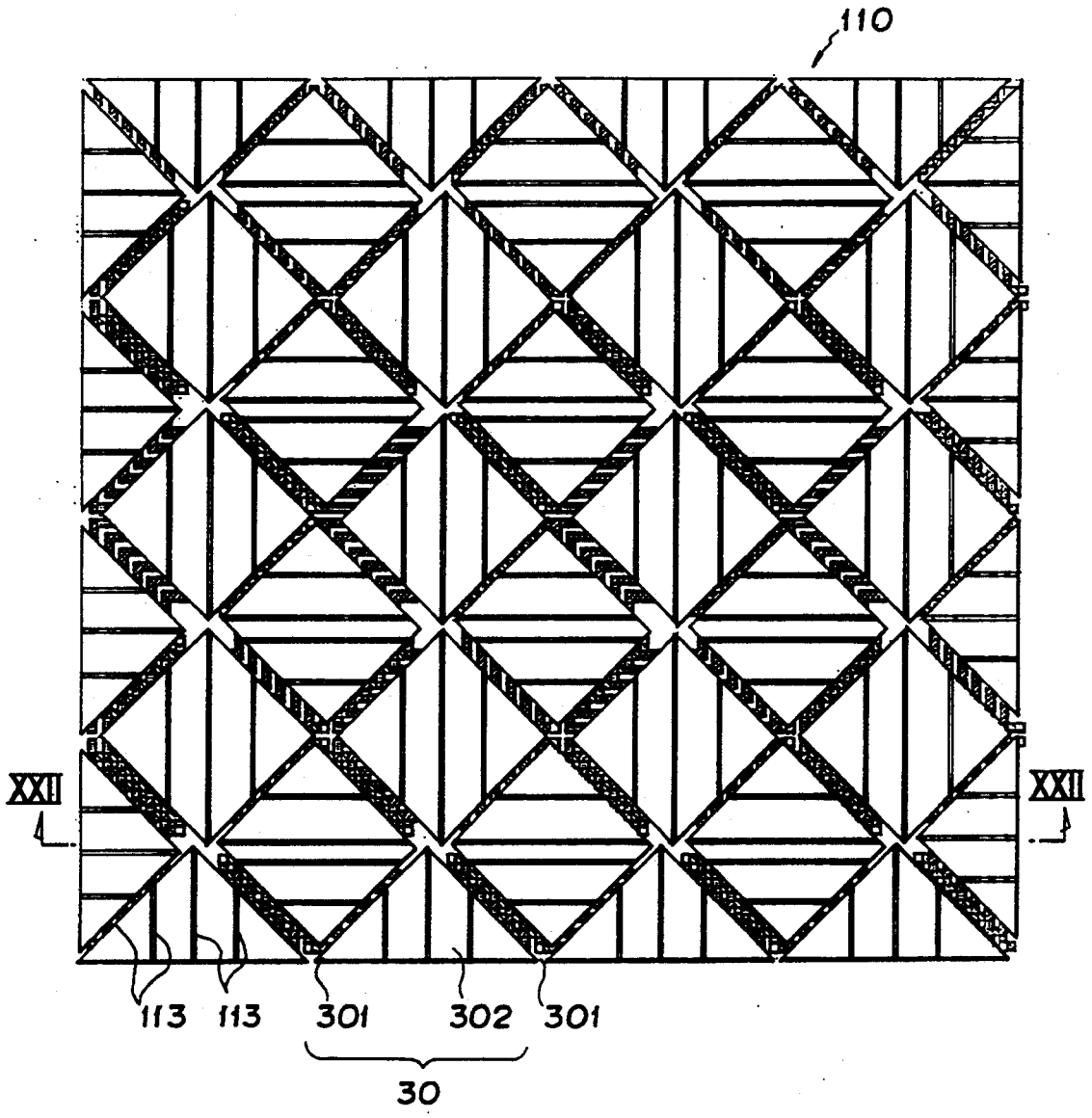
FIG. 22A is a plan view showing the structure of the integrated thin film transformer apparatus in embodiment 16 of the present invention.
Figure 22B:
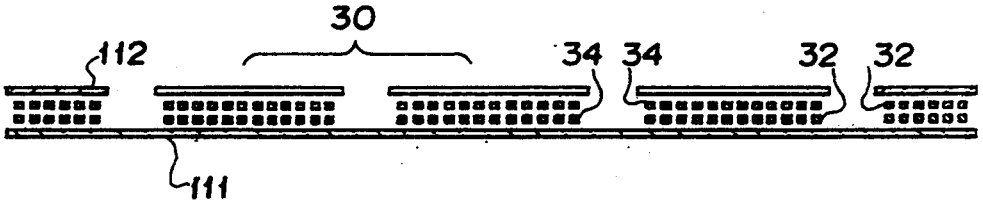
FIG. 22B is a cross-sectional view taken along the line XXII—XXII in FIG. 22A.

Now, referring to FIGS. 22A and 22B, what is disclosed is an integrated thin film transformer in accordance with embodiment 16 of the present invention. FIG. 22A is a plan view showing the overall structure of the integrated thin film transformer apparatus of this embodiment, and FIG. 22B is a cross-sectional view along line XXII—XXII in FIG. 22A. The structure of the individual thin film transformers forming the integrated thin film transformer of this embodiment is similar to that of the thin film transformer of embodiment 7, and hence, like parts used in both embodiments are assigned like numerals and redundant explanations will not be repeated here.

In FIGS. 22A and 22B, an individual thin film transformer 30 of the integrated thin film transformer 110 of this embodiment is also formed without terminals inside the coil loop. On the other hand, at the lower-layer side and the upper-layer side of the first thin film coil 32 and the second thin film coil 34, both forming the thin film transformer 30, a lower magnetic material layer 111 and an upper magnetic material layer 112 are formed. Therefore, the intensity of the magnetic field developed around the coil can be enlarged. Furthermore, since the magnetic flux can be captured by the lower magnetic material layer 111 and the upper magnetic material layer 112, magnetic flux leakage can be reduced, and hence, the intensity of the magnetic field can be further increased.

And furthermore, at the lower magnetic material layer 111 and the upper magnetic material layer 112 in the integrated thin film transformer 110 of this embodiment, slits 113 are provided as a buffer for eddy currents by breaking the eddy currents. The first thin film coil 32 and the second thin film coil 34 of a thin film transformer 30 are formed so as to be shaped in plane spiral pattern in which there are four corner parts 301 and four straight parts 302 (parallel parts) between pairs of corner parts 301, and the slits 113 of the lower magnetic material layer 111 and the upper magnetic material layer 112 are formed between the corner parts 301. Furthermore, slits 113 are formed at regions extending between the corner parts 302.

In the integrated thin film transformer 110 structured as above in this embodiment, the magnetic flux can pass easily through the slits 113, and energy loss due to eddy current is reduced as much as possible based on the principle of a cut core transformer in which the eddy current path is broken. Hence, the conversion efficiency is very high.

Embodiment 17

Now, referring to FIGS. 23A and 23B, FIGS. 24A and 24B, and FIGS. 25A and 25B, what is disclosed is an integrated thin film transformer apparatus in accordance with embodiment 17 of the present invention (a thin film transformer apparatus using the first measure of the present invention which has first and second thin film coils, each coil having a different number of turns and there being a different number of connections between coil parts, and the number of separated and parallel paths for the individual coil parts in the lower-layer and the upper-layer being three or more).

Figure 23A:
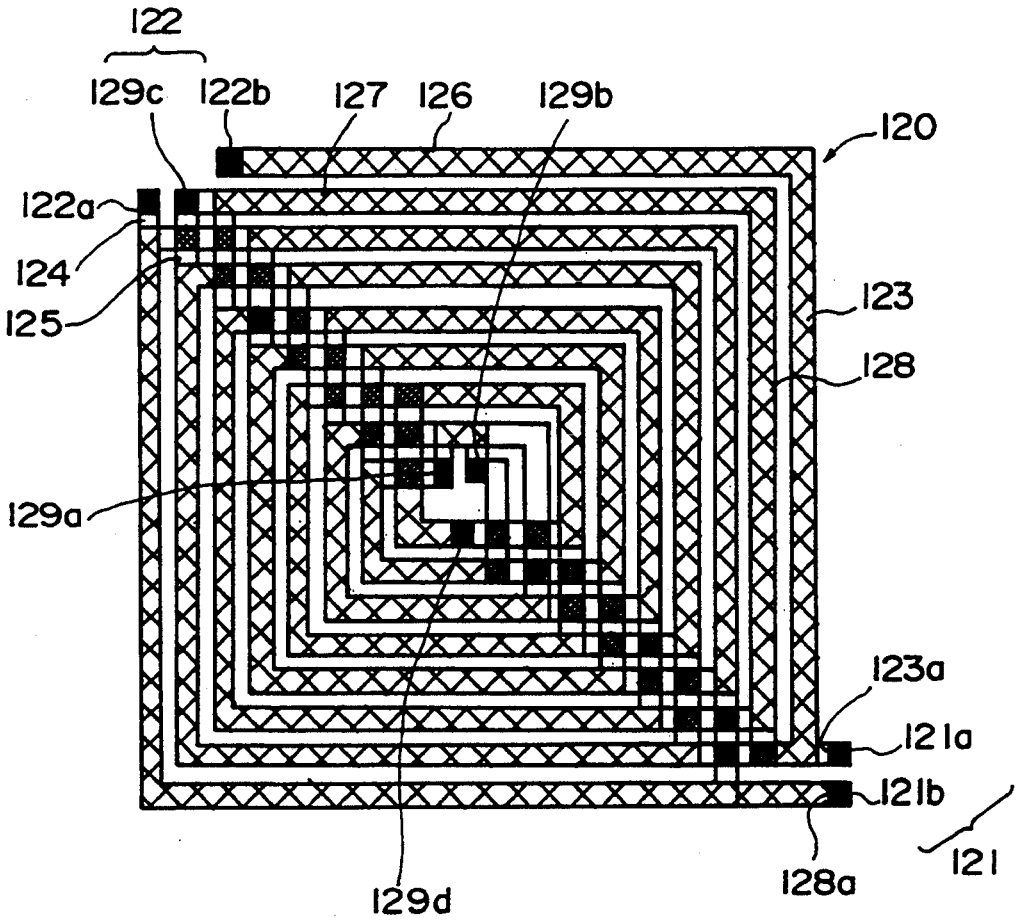
FIG. 23A is a plan view showing the coil pattern of the thin film transformer in embodiment 17 of the present invention.
Figure 23B:
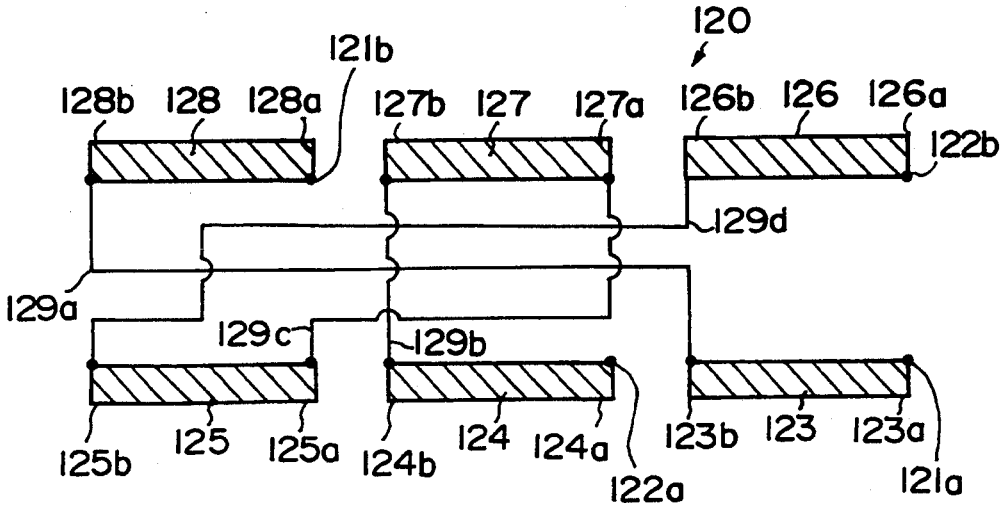
FIG. 23B is a diagrammatic view showing the connections between coil parts forming the thin film transformer.

FIG. 23A is a plan view showing the coil pattern of the single thin film transformer in this embodiment, and FIG. 23B is a diagrammatic view of the connection structure between individual coils in the first and second thin film coils forming the single thin film transformer.

Figure 24A:
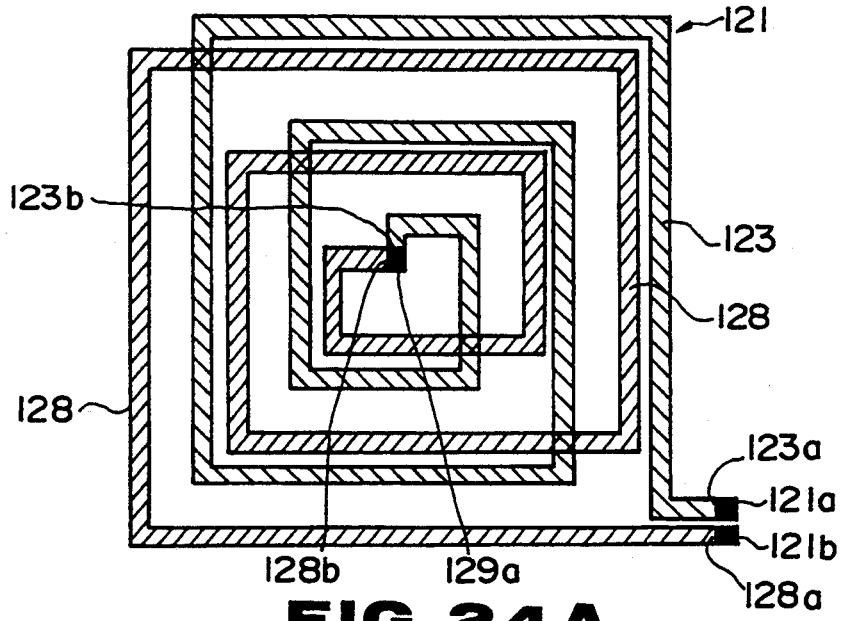
FIG. 24A is a plan view showing the coil pattern of the first thin film coil of the thin film transformer shown in FIG. 22.
Figure 24B:
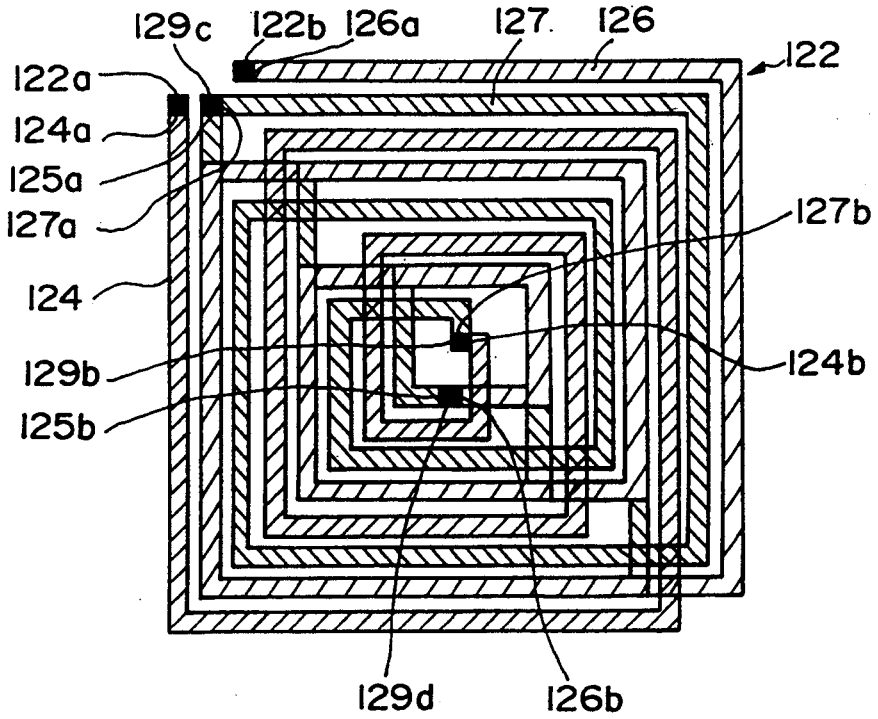
FIG. 24B is a plan view showing the coil pattern of the second thin film coil.

FIG. 24A is a plan view showing the coil pattern of the first thin film coil of the thin film transformer of this embodiment, and FIG. 24B is a plan view showing the coil pattern of the second thin film coil.

Figure 25A:
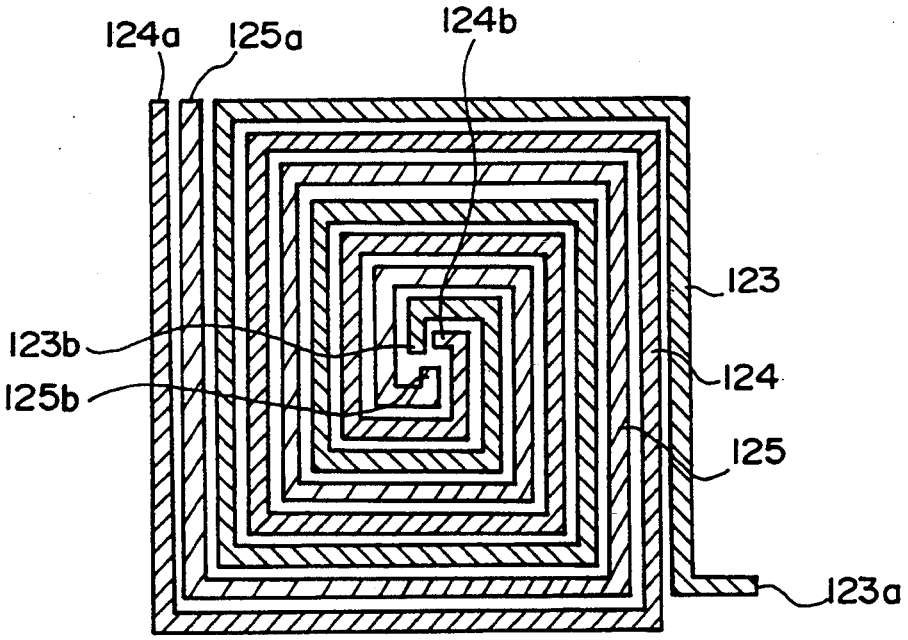
FIG. 25A is a plan view showing the spiral pattern of each of the lower-layer coil parts of the thin film transformer shown in FIGS. 23A and 23B.
Figure 25B:
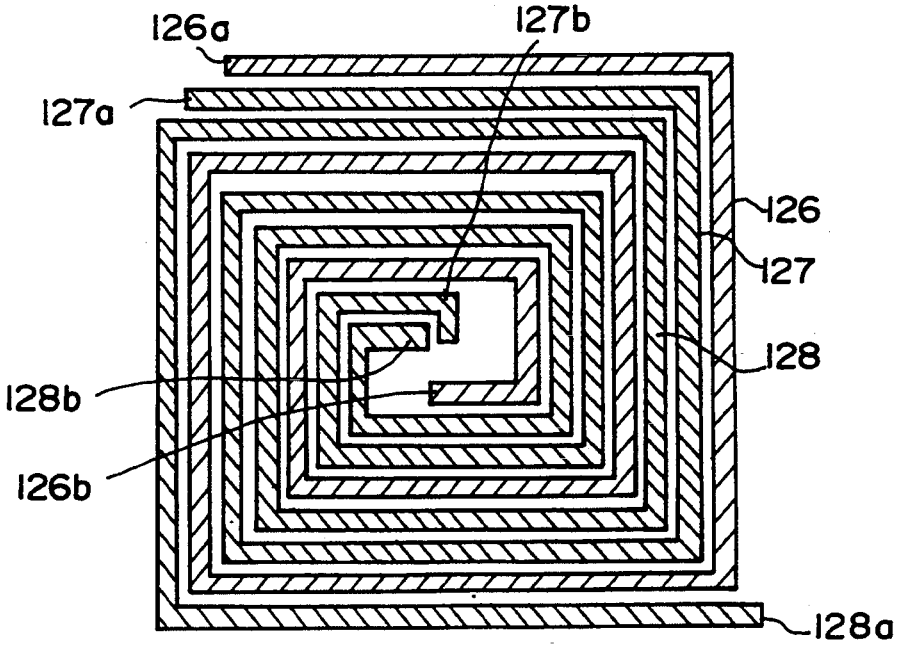
FIG. 25B is a plan view showing the spiral pattern of each of the upper-layer coil parts of the thin film transformer shown in FIGS. 23A and 23B.

FIG. 25A is a plan view showing the spiral pattern of each of the lower-layer coil parts (the first, second, and third lower-layer coil parts) forming the thin film transformer of this embodiment, and FIG. 25B is a plan view showing the spiral pattern of each of the upper-layer coil parts (the first, second, and third upper-layer coil parts) of the thin film transformer of this embodiment.

At first, in FIGS. 23A and 23B, the thin film transformer 120 is fabricated on a substrate and has a first thin film coil 121 and a second thin film coil 122. The first thin film coil 121 is shaped as a spiral coil and consists of aluminum (conductive material), and has a thickness of from 1 to 3 μm and a width of from 10 to 200 μm. The second thin film coil 122 is also shaped as a spiral coil and consists of aluminum (conductive material), and has a thickness of from 1 to 3 μm and a width of from 10 to 200 μm. The first and second thin film coils 121 and 122 consist of a combination of first, second, and third lower-layer coil parts 123, 124 and 125 and first, second and third upper-layer coil parts 126, 127 and 128. As shown in FIG. 25A, the first, second, and third lower-layer coil parts 123, 124 and 125 are located below the insulation layer, and as shown in FIG. 25B, the first, second, and third upper-layer coil parts 126, 127 and 128 are located above the insulation layer; the lower-layer coil parts 123, 124 and 125 and the upper-layer coil parts 126, 127 and 128 have an identical shape and the coil thickness and the size of coil gaps are selected so as to maintain an allowable clearance between conductive material parts. The ends 123*a*, 124*a* and 125*a* of the outer loops of the lower-layer coil parts 123, 124 and 125 are located outside the outer loops of the coils. In addition, the ends 126*a*, 127*a* and 128*a* of the outer loops of the upper-layer coil parts 126, 127 and 128 are located outside the outer loops of the coils. The structure of the first thin film coil 121 is shown schematically in FIG. 24A. The end 123*b* of the inner loop of the first lower-layer coil part 123 and the end 128*b* of the inner loop of the third upper-layer coil part 128 are connected to each other through a connection hole 129*a* formed in the insulation layer, and the terminals 121*a* and 121*b* are defined as the end 123*a* of the outer loop of the first lower-layer coil part 123 and the end 128*a* of the outer loop of the third upper-layer coil part 128. In contrast, in the second thin film coil 122, whose structure is shown schematically in FIG. 24B, the end 124*b* of the inner loop of the second lower-layer coil part 124 and the end 127*b* of the inner loop of the second upper-layer coil part 127 are connected to each other through a connection hole 129*c* formed in the insulation layer, and the end 125*b* of the inner loop of the third lower-layer coil part 125 and the end 126*b* of the inner loop of the first upper-layer coil part 126 are connected to each other through a connection hole 129*d* formed in the insulation layer, and the terminals 122*a* and 122*b* are defined as the end 124*a* of the outer loop of the second lower-layer coil part 124 and the end 126 of the outer loop of the first upper-layer coil part 126.

Also in the thin film transformer 120 formed as described above, the first thin film coil 121 and the second thin film coil 122 are connected electrically with a designated combination of connections between the lower-layer coil parts 123, 124 and 125 and the upper-layer coils 126, 127 and 128, and the terminals 121*a*, 122*a*, 122*b*, 121*b* are defined as the ends 123*a*, 124*a*, 126*a* and 128*a* of the outer loops of the relevant coil parts. Therefore, as there are no internal terminals inside the thin film transformer 120 where the magnetic flux with maximum intensity is generated, metallic wiring need not be installed inside the thin film transformer 120, and the external magnetic field, if any, developed by the current running in the metallic wires for conveying electric power does not disturb the generic magnetic field formed by the first thin film coil 121 and the second thin film coil 122. In addition, if an integrated thin film transformer is formed by arranging a plurality of thin film transformers 120 on the surface of the substrate, the terminals 121*a*, 121*b*, 122*a* and 122*b* to the integrated thin film transformer are located only at the outer peripheral edges, and with respect to the wiring method for the individual thin film transformers 120, it may be possible to form the wiring with conductive materials formed at the same time when the individual thin film transformers are formed. Therefore, since wiring can be prepared without wire bonding, an integrated thin film transformer can be fabricated inexpensively in a simplified process which leads to the same effect brought by the thin film transformer of embodiment 7.

And furthermore, in the thin film transformer 120 of this embodiment, the first lower-layer coil part 123 and the third upper-layer coil part 128 of the first thin film coil 121 are connected electrically to each other in series, and the second lower-coil part 124, the second upper-layer coil part 127, the third lower-layer coil part 125 and the first upper-layer coil part 126 of the second thin film coil 122 are connected electrically to one another in series. Owing to this configuration, since the number of connections in the first thin film coil 121 is different from that in the second thin film coil 122, the ratio of the number of turns of the first thin film coil 121 to that of the second thin film coil 122 is made to be 1:2. Furthermore, by selecting the number of connections in the first and second thin film coils 121 and 122, it is possible to make the ratio of the number of turns 2:1. In addition, the ratio of the number of turns of the first thin film coil 121 and that of the second thin film coil 122 can be determined arbitrarily in response to the number of connections between the lower-layer coil parts and the upper-layer coil parts. For example, if the number of parallel coil parts in the lower-layer and in the upper-layer is selected to be 4 for each layer, a thin film transformer having a turns ratio of "1:3", "2:2" (equivalent to "1:1",) or "3:1" can be made. Similarly, if the number of parallel coil parts in the lower-layer and in the upper-layer is selected to be 5 for each layer, a thin film transformer having a turns ratio of "1:4", "2:3". "3:2" or "4:1" can be easily made.

The thin film transformer 120 having the structure described above can be easily fabricated using the following manufacturing process, which is similar to the process for making the thin film transformer of embodiment 7.

For example, after forming a silicon dioxide layer having a thickness of from 0.1 to 2 μm as an insulation layer on the surface of a substrate consisting of silicon, an aluminum layer having a thickness of from 1 to 3 μm is formed on the silicon dioxide layer. The aluminum layer is then processed by lithography processing or etching processing to provide lower-layer coil parts 123, 124 and 125, as shown in FIG. 25A, having a width of from 10 to 200 μm. The first lower-layer coil part 123 is used for forming the first thin film coil 121, and the second and third lower-layer coil parts 124 and 125 are used for forming the second thin film coil 122.

Next, a silicon dioxide insulation layer having a thickness of from 0.1 to 2 μm is formed on these "aluminum line" coil parts, and the connection holes 129*a*, 129*b*, 129*c* and 129*d*, are formed respectively above the end 123*b* of the inner loop of the first lower-layer coil part 123, the end 124*b* of the inner loop of the second lower-layer coil part 124, the end 125*a* of the outer loop of the third lower-layer coil part 125, and the end 125*b* of the inner loop of the third lower-layer coil part.

Next, an aluminum layer having a thickness of from 1 to 3 μm is deposited and lithography processing and etching processing are used to form the upper-layer coil parts 126, 127 and 128, which have a width of from 10 to 20 μm. With these processes, the open connection holes 129*a*, 129*b*, 129*c* and 129*d* are filled with aluminum, and the lower-layer coil parts 123, 124 and 125 are connected to the upper-layer coil parts 125, 127 and 128 so as to form the structure shown in FIGS. 23A and 23B, FIGS. 24A and 24B, and FIGS. 25A and 25B.

And afterward, a silicon dioxide insulation layer having a thickness of from 0.1 to 2 μm is formed on the surface of the upper-layer coil parts. The terminals 121*a*, 122*a*, 122*b* and 121*b* are formed as open holes at the end 123*a* of the outer loop of the first lower-layer coil 123, the end 124*a* of the outer loop of the second lower-layer coil 124, the end 126*a* of the outer loop of the first upper-layer coil 126, and the end 128*a* of the outer loop of the third upper-layer coil 128, so that a thin film transformer 120 as shown in FIGS. 23A and 23B results.

In order to modify the ratio of the number of turns and the number of connections between the upper-layer coil parts and the lower-layer coil parts, the processing for forming patterns on the aluminum layers and the processing for opening holes in the insulation layers may be adjusted.

The above mentioned structures for the thin film transformers of embodiment 1 and embodiment 7 are not limited to those disclosed here, but any combination of individual structures generic to the thin film transformers in the embodiments 1 and 7 may be allowed. In addition, the number of turns of the coils of the thin film transformers and the number of individual thin film transformers assembled in a single unit to form an integrated thin film transformer can be selected and modified in response to the purpose of the apparatus and hence they are not limited to the examples described in the above embodiments.

What is claimed is:

1. An integrated thin film transformer apparatus comprising:

a substrate; and a plurality of thin film transformers carried by said substrate and arranged adjacent to one another, each of said thin film transformers including a first thin film coil consisting of a conductive material formed in a spiral pattern, said conductive material of said spiral pattern having turns which are spaced apart by gaps having a predetermined gap width, an insulation layer formed over said first thin film coil, and a second thin film coil over said insulation layer, said second thin film coil consisting of a conductive material formed in a spiral pattern, said conductive material of said spiral pattern of said second thin film coil having turns which are spaced apart by gaps having a predetermined gap width, wherein the distance between adjacent thin film transformers is less than or equal to said gap width of said first thin film coils and is additionally less than or equal to said gap width of said second thin film coils, wherein said first thin film coils of said thin film transformers are connected electrically to each other in parallel, and wherein said second thin film coils of said thin film transformers are connected electrically to each other in parallel.

2. The integrated thin film transformer apparatus as claimed in claim 1, wherein said spiral pattern of said first thin film coil of a thin film transformer and said spiral pattern of said second thin film coil of the same thin film transformer are substantially identical and occupy substantially identical positions on said substrate.

3. The integrated thin film transformer apparatus as claimed in claim 1, wherein thin film transformers that are adjacent are arranged in a line symmetry with respect to a central line passing through a central point of said thin film transformers on said substrate.

4. The integrated thin film transformer apparatus as claimed in claim 1, wherein at least one pair of thin film transformers that are adjacent share commonly a coil element included in an outermost turn of said first thin film coils of said at least one pair; and wherein said at least one pair of thin film transformers that are adjacent additionally share commonly a coil element included in an outermost turn of said second thin film coils of said at least one pair.

5. The integrated thin film transformer apparatus as claimed in claim 1, further comprising a magnetic material layer which is electrically insulated from said first thin film coils and said second thin film coils.

6. The integrated thin film transformer apparatus as claimed in claim 5, wherein said magnetic material layer is positioned between said substrate and said first thin film coils.

7. The integrated thin film transformer apparatus as claimed in claim 5, wherein said magnetic material layer has slits to provide eddy current buffering.

8. The integrated thin film transformer apparatus as claimed in claim 7, wherein said spiral patterns of said first thin film coils and said second thin film coils include a plurality of corner parts in every coil turn and straight parts connecting between pairs of said corner parts; and wherein, in each thin film transformer, at least some of said slits in said magnetic material layer extend along paths which follow said corner parts in every turn of said first thin film coil and said second thin film coil and are transverse with respect to said straight line parts.

9. The integrated thin film transformer apparatus as claimed in claim 8, wherein, in each thin film transformer, some of said slits in said magnetic material layer extend along paths which are parallel to some of said straight line parts in every coil loop of said first thin film coil and said second thin film coil.

10. The integrated thin film transformer apparatus as claimed in claim 5, wherein said magnetic material layer is positioned between said first thin film coils and said second thin film coils.

11. The integrated thin film transformer apparatus as claimed in claim 5, wherein said magnetic material layer is positioned above said second thin film coils.

12. The integrated thin film transformer apparatus as claimed in claim 1, further comprising a guard ring of magnetic material layer surrounding said thin film transformers.

13. The integrated thin film transformer apparatus as claimed in claim 1, wherein each thin film transformer has a central region where said conductive material of said first and second thin film coils does not exist, and further comprising magnetic material in the central regions of the thin film transformers.

14. The integrated thin film transformer apparatus as claimed in claim 1, further comprising a lower magnetic material layer between said first thin film coils and said substrate and an upper magnetic material layer above said second thin film coils;

wherein each thin film transformer has a central region where said conductive material of said first and second thin film coils does not exist, and wherein said lower magnetic material layer and said upper magnetic material layer are connected to each other through said central regions of said thin film transformers.

15. The integrated thin film transformer apparatus as claimed in claim 1, wherein said substrate consists of one material selected from the group consisting of semiconductor, glass, film and metal.

16. An integrated thin film transformer apparatus having a primary winding and a secondary winding, comprising:

a substrate; and a plurality of individual thin film transformers which are arranged adjacent to one another on the substrate, each individual thin film transformer having a primary winding which includes a first thin film coil and having a secondary winding which includes a second thin film coil, all of the first thin film coils being disposed in a first plane and all of the second thin film coils being disposed in a second plane which is parallel to the first plane, wherein the primary windings of the individual thin film transformers are electrically connected to each other in parallel to form the primary winding of the integrated thin film transformer apparatus and the secondary windings of the individual thin film transformers are electrically connected to each other in parallel to form the secondary winding of the integrated thin film transformer apparatus.

17. An integrated thin film transformer apparatus as claimed in claim 16, wherein each thin film coil comprises a plurality of straight segments of conductive material, the straight segments being connected perpendicularly to form a squarish spiral.

18. An integrated thin film transformer apparatus as claimed in claim 17, wherein at least one first thin film coil shares a straight segment of conductive material with an adjacent first thin film coil and at least one second thin film coil shares a straight segment of conductive material with an adjacent second thin film coil.

19. An integrated thin film transformer apparatus as claimed in claim 17, wherein there are four individual transformers, arranged substantially in two rows and two columns.

20. An integrated thin film transformer apparatus as claimed in claim 19, wherein the individual transformers in each row are arranged symmetrically with respect to a straight line between the columns and the individual transformers of each column are arranged symmetrically with respect to a straight line between the rows.

21. An integrated thin film transformer apparatus as claimed in claim 17, wherein each of the individual thin film transformers further comprises magnetic material which is disposed in a plane that is parallel to the first and second planes.

22. An integrated thin film transformer apparatus as claimed in claim 21, wherein slits are provided in the magnetic material.

23. An integrated thin film transformer apparatus as claimed in claim 22, wherein at least some of the slits are oriented at an angle of substantially 45° with respect to the straight segments of conductive material.

24. An integrated thin film transformer apparatus as claimed in claim 22, wherein at least some of the slits are oriented substantially parallel to some of the straight segments of conductive material and perpendicular to others of the straight segments of conductive material.

25. An integrated thin film transformer apparatus as claimed in claim 16, wherein each of the thin film coils has a central region, the central regions of the first and second thin film coils of a given individual thin film transformer being aligned, and wherein each of the individual thin film transformers further comprises magnetic material which extends through the central regions of the first and second thin film coils thereof.

26. An integrated thin film transformer apparatus as claimed in claim 16, wherein one of the first and second planes is a lower plane and the other of the first and second planes is an upper plane, the lower plane being closer to the substrate than the upper plane, and wherein each of the thin film coils that is disposed in the upper plane is located directly above a corresponding one of the thin film coils that is disposed in the lower plane and has a configuration that is substantially the same and the configuration of the corresponding one of the thin film coils that is disposed in the lower plane.

27. An integrated thin film transformer apparatus as claimed in claim 16, wherein the primary winding of each individual thin film transformer additionally includes an additional thin film coil which is disposed in an additional plane that is parallel to the first and second planes.

28. An integrated thin film transformer apparatus as claimed in claim 27, wherein the secondary winding of each individual thin film transformer further includes a further thin film coil which is disposed in a further plane that is parallel to the first and second planes.

29. An integrated thin film transformer apparatus as claimed in claim 28, wherein, in each individual thin film transformer the first thin film coil thereof and the additional thin film coil thereof are connected electrically in parallel, and the second thin film coil thereof and the further thin film coil thereof are connected electrically in parallel.

30. An integrated thin film transformer apparatus as claimed in claim 16, wherein the secondary winding of each individual thin film transformer further includes a further thin film coil which is disposed in a further plane that is parallel to the first and second planes.

31. An integrated thin film transformer apparatus as claimed in claim 16, wherein the first and second thin film coils comprise conductive material, wherein the conductive material of each first thin foil coil is arranged in a spiral pattern having turns which are spaced apart by a predetermined gap width, wherein the conductive material of each second thin film coil is arranged in a spiral pattern having turns which are spaced apart by a predetermined gap width, and wherein the distance between adjacent individual thin film transformers is less than or equal to the gap width of the first thin film coils and is additionally less than or equal to the gap width of the second thin film coils.

32. An integrated thin film transformer apparatus as claimed in claim 16, wherein the first thin film coils comprise conductive material, wherein the conductive material of each first thin film coil is arranged in a spiral pattern having straight segments, wherein the conductive material in the straight segments has a predetermined conductor width, and wherein the distance between adjacent individual thin film transformers is not greater than about the conductor width of the straight segments of the first thin film coils.

* * * * *